United States Patent [19]

Sasaki et al.

[11] Patent Number: 4,713,956

[45] Date of Patent: Dec. 22, 1987

[54] APPARATUS FOR MANUFACTURING SPRING UNITS

[75] Inventors: Noboru Sasaki; Yasuji Iwata; Teruo Mukai, all of Tokyo, Japan

[73] Assignee: France Bed Co., Ltd., Tokyo, Japan

[21] Appl. No.: 626,435

[22] Filed: Jun. 29, 1984

[30] Foreign Application Priority Data

| | | | |
|---|---|---|---|
| Jul. 4, 1983 | [JP] | Japan | 58-120342 |
| Jul. 4, 1983 | [JP] | Japan | 58-120343 |
| Jul. 4, 1983 | [JP] | Japan | 58-120344 |
| Jul. 4, 1983 | [JP] | Japan | 58-120345 |
| Jul. 4, 1983 | [JP] | Japan | 58-120346 |
| May 14, 1984 | [JP] | Japan | 59-94728 |

[51] Int. Cl.[4] ..... B21F 35/02; B21F 45/00

[52] U.S. Cl. ..... 72/137; 140/71 R

[58] Field of Search ..... 72/137, 138, 142, 143, 72/144; 140/3 CA, 71 R, 102, 104, 105

[56] References Cited

U.S. PATENT DOCUMENTS

| | | | |
|---|---|---|---|
| 112,868 | 3/1871 | Van Vleck | 72/137 |
| 904,563 | 11/1908 | Rau | 140/71 R |
| 3,402,584 | 9/1968 | Cavagnero | 72/137 |
| 3,905,403 | 9/1975 | Smith et al. | 72/137 X |
| 3,906,766 | 9/1975 | Sato | 72/12 |
| 3,937,256 | 2/1976 | Hamaguchi | 140/71 R |
| 3,993,106 | 11/1976 | Yokota | 140/71 R |
| 4,030,327 | 6/1977 | Collins et al. | 72/23 |
| 4,373,516 | 2/1983 | Masuda et al. | 128/57 |
| 4,471,819 | 9/1984 | Nihashi | 140/71 R |

FOREIGN PATENT DOCUMENTS

| | | | |
|---|---|---|---|
| 356428 | 10/1931 | United Kingdom | 72/143 |
| 856521 | 12/1960 | United Kingdom | 72/137 |

*Primary Examiner*—E. Michael Combs

*Attorney, Agent, or Firm*—Frishauf, Holtz, Goodman & Woodward

[57] ABSTRACT

In an apparatus for manufacturing springs, a frame body has guide rails on which a pair of movable bodies are mounted to be movable. Each of the movable bodies has rotatable holding rollers between which a wire which is to be processed is held, and each body also has a shaping roller for bending the end of the wire in a coil. Arranged between the shaping roller and the holding rollers are a guide member for defining the supply passage for the wire, and a pitch rod for determining the pitch of the coil formed. When the holding rollers are rotated, while holding the wire, the movable bodies are moved toward each other by the pulling force exerted to the wire, and the wire is supplied from between the paired holding rollers to the shaping roller through the guide member. The pitch rod is reciprocated as the movable bodies run, and as one turn of the wire coil strikes against the pitch rod, making it possible to form spiral springs at both ends of the wire.

28 Claims, 56 Drawing Figures

APPARATUS FOR MANUFACTURING SPRING UNITS

BACKGROUND OF THE INVENTION

The present invention relates to an apparatus for manufacturing spring units suitable for forming mattresses or box spring mattresses.

Spring units each comprising a wire whose both ends are formed as torsion bar springs have been well-known as the spring units used in forming mattresses or box spring mattresses. It has been pointed out, however, that the mattress formed by torsion bar springs has the following problem. Because the torsion bar spring has small deformation ability relative to the compressed load applied, when incorporated into a mattress it has the necessary hardness to reliably support a person. However, the mattress is likely to be strained permanently when a load is repeatedly applied to it, as the spring unit provided with torsion bar springs quickly loses its elasticity.

In order to solve this problem, therefore, a mattress which is formed by spring units each comprising a wire whose both ends are formed as coil springs is proposed by U.S. Ser. No. 493,330 filed May 10, 1983 and its corresponding EPC Application No. 83105291.5 filed May 27, 1983.

When the spring portion is formed by a coil spring, it has better fatique characteristics, as compared with the torsion bar spring portion, and the elasticity of the spring unit can be thus kept good over a long time period. However, no apparatus has yet been developed for mass producing spring units comprising a linear portion whose both ends are formed as continuous coil springs. This is the reason why it has not been possible to provide box spring mattresses having spring units with coil springs.

SUMMARY OF THE INVENTION

The object of the present invention is to provide an apparatus for manufacturing spring units each comprising a wire having a linear portion and continuous coil spring portions formed at both ends of the linear portion.

According to the present invention, there is provided an apparatus for manufacturing spring units comprising: a frame having guide rails; first and second running members mounted on the guide rails; first and second holding means provided on the paired running members, respectively, to hold both ends of a wire which is to be formed as a spring unit; and first and second coil forming means mounted on the running members, respectively, to bend and spiral those portions of the wire which extend outside from the first and second holding means, as the first and second running members move toward each other.

DETAILED DESCRIPTION OF THE PREFERRED EMBODIMENT

Figure 1A:
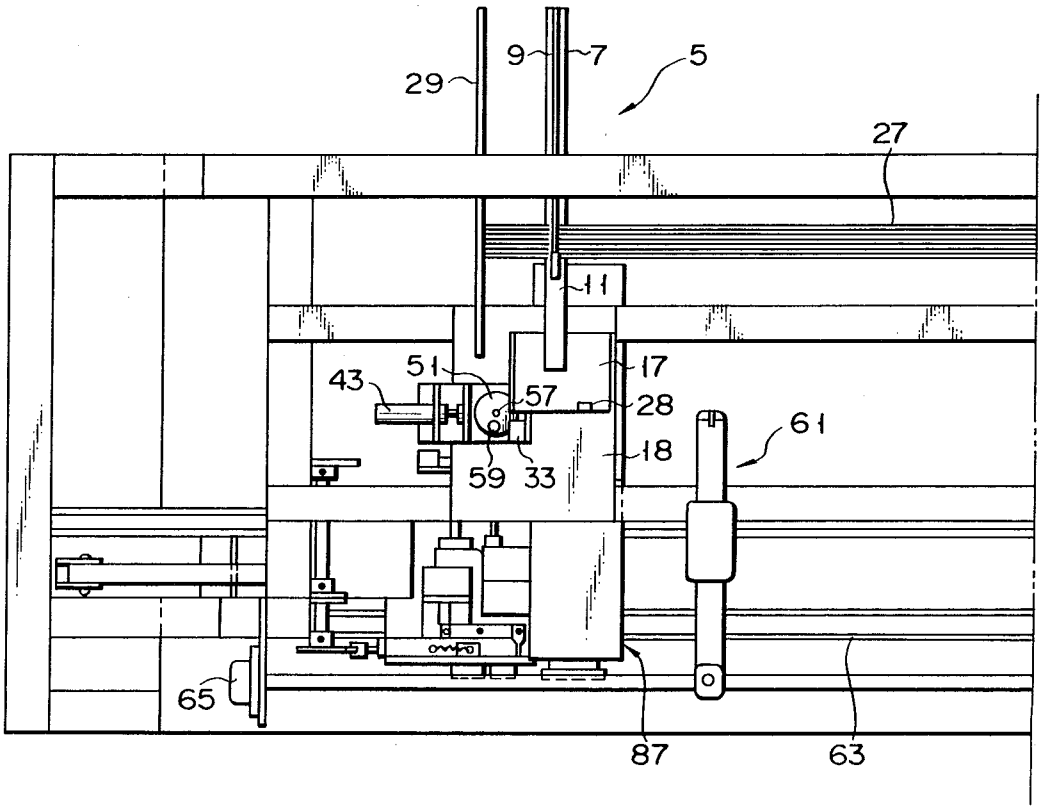
FIGS. 1A and 1B are plan views showing a first embodiment of a shaping apparatus for manufacturing spring units according to the present invention.
Figure 1B:
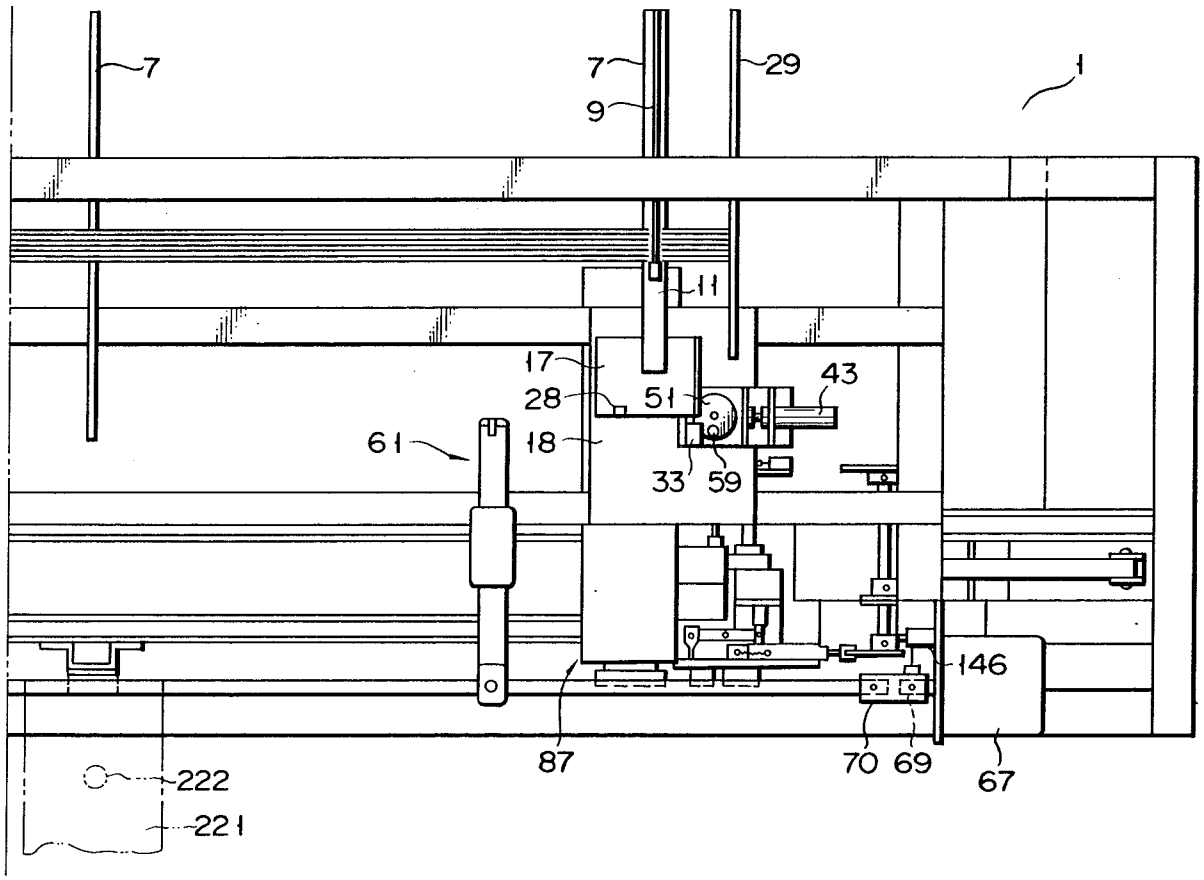
Figure 2A:
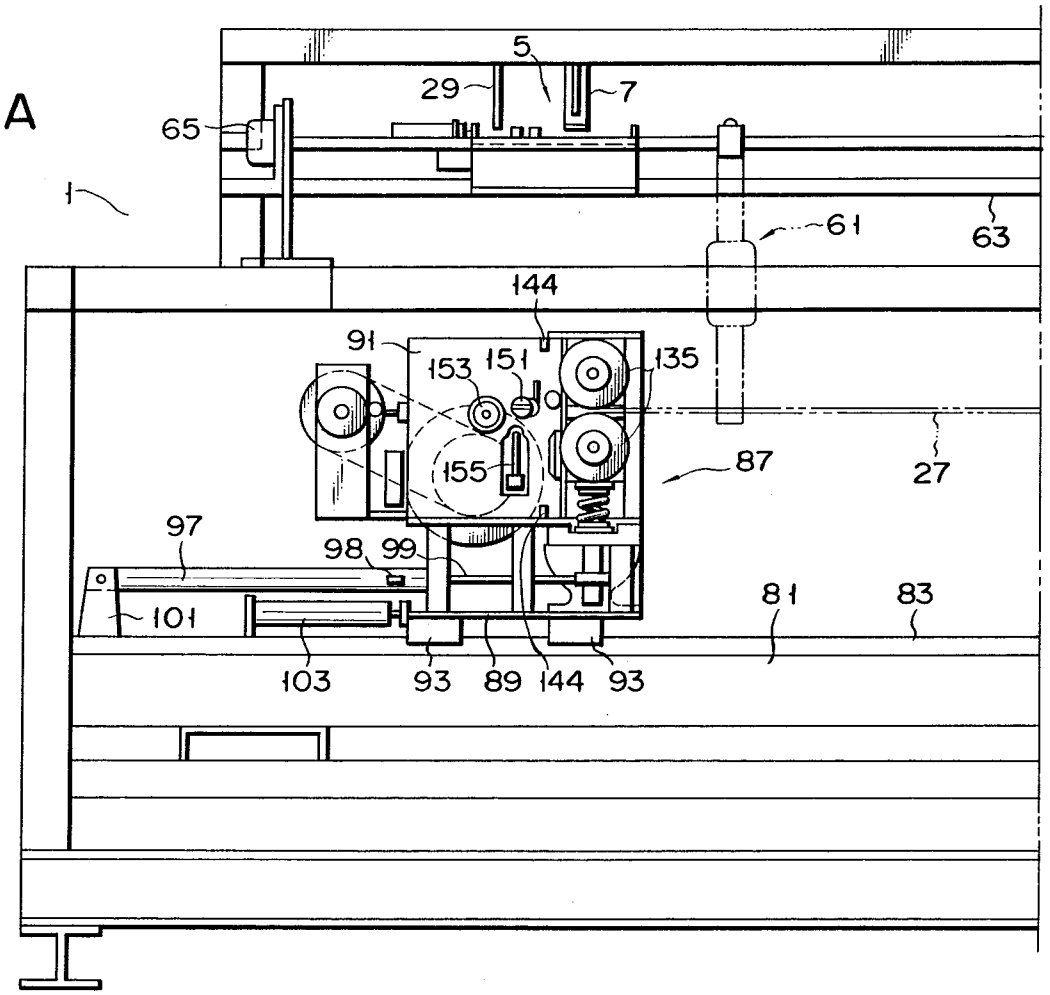
FIGS. 2A and 2B are front views showing the shaping apparatus of FIGS. 1A and 2A.
Figure 2B:
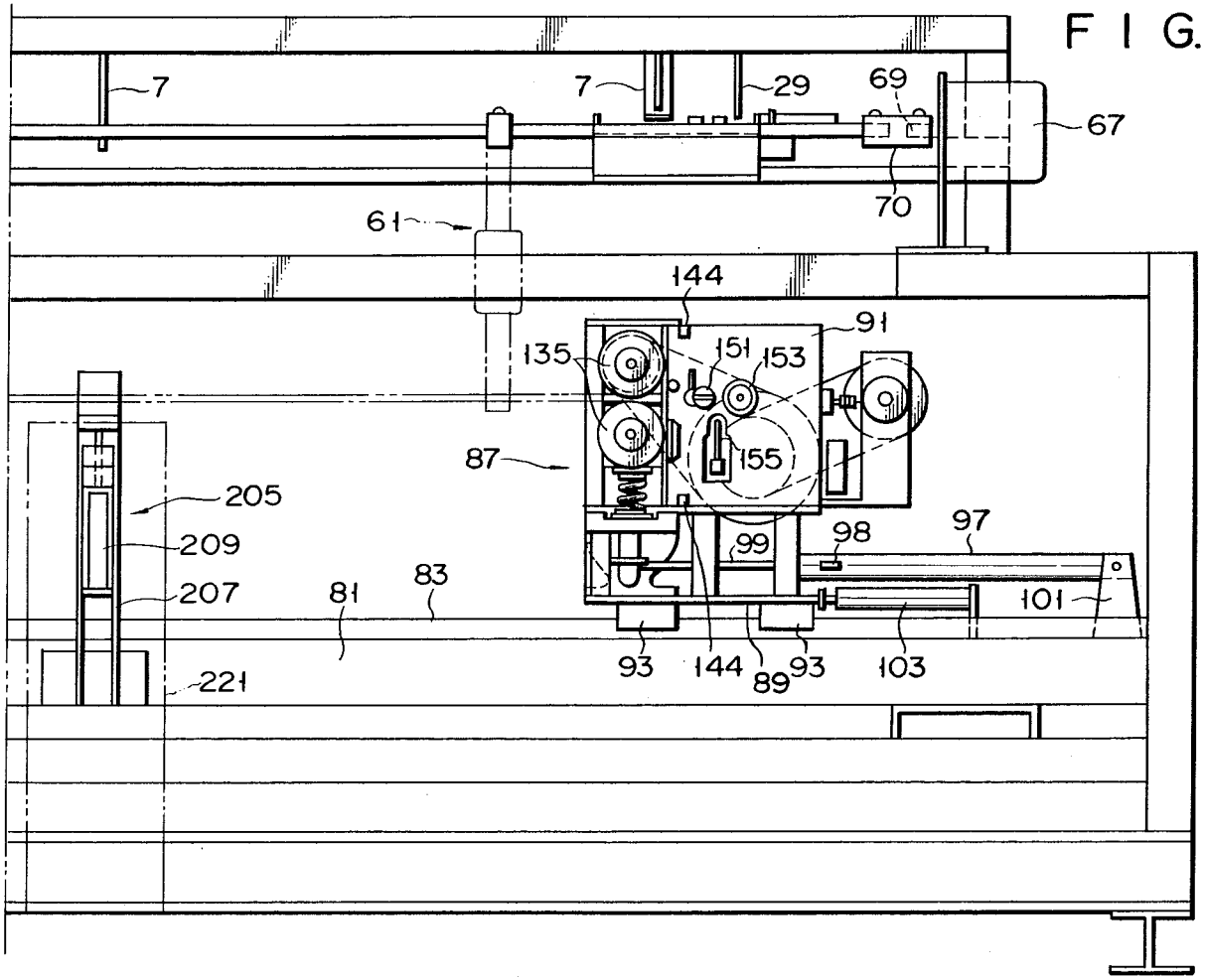
Figure 3:
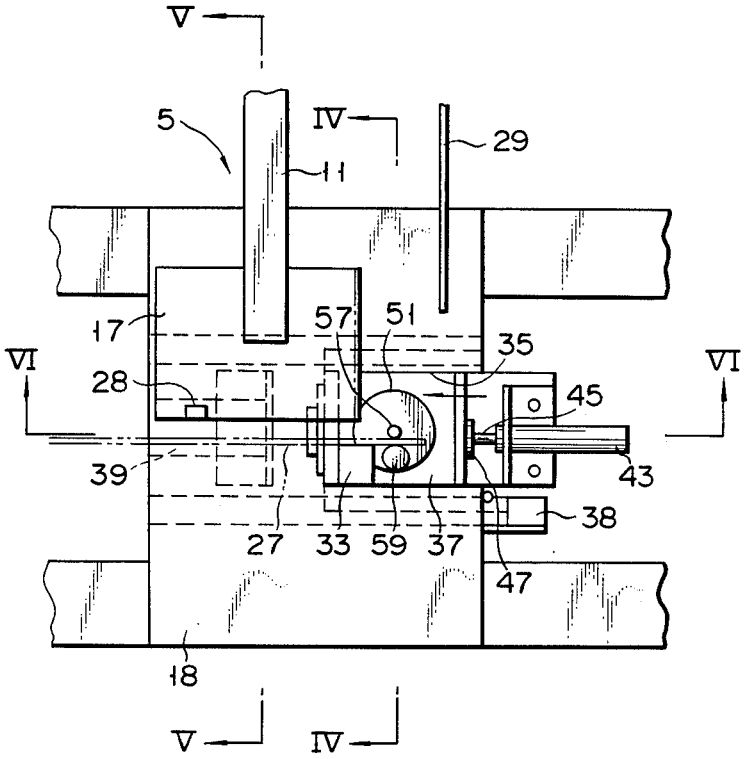
FIG. 3 is an explanded plan view of the right side of FIGS. 1A and 1B showing part of a stacking section where the wires shown in FIGS. 1A and 1B are stacked.
Figure 4:
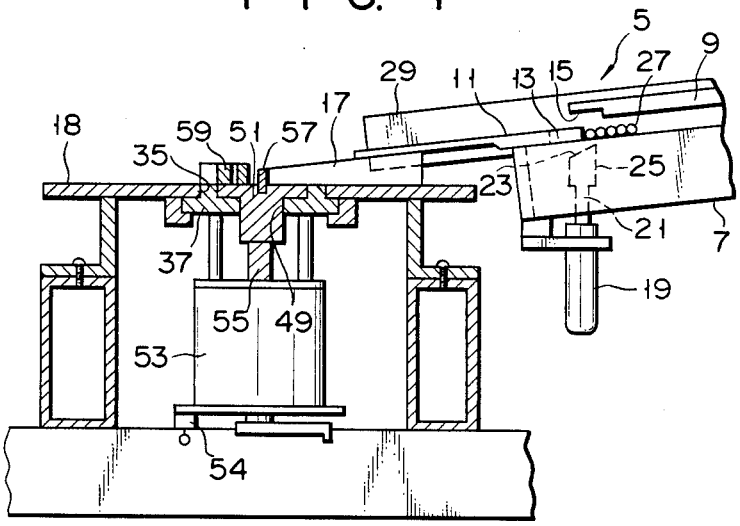
FIG. 4 is a sectional view taken along a line IV—IV in FIG. 3.
Figure 5:
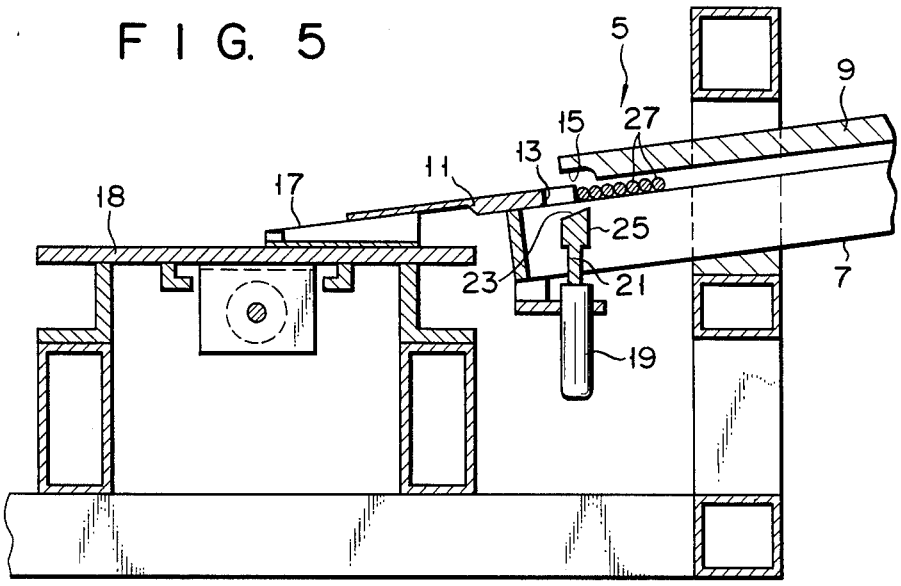
FIG. 5 is a sectional view taken along a line V—V in FIG. 3.
Figure 7:
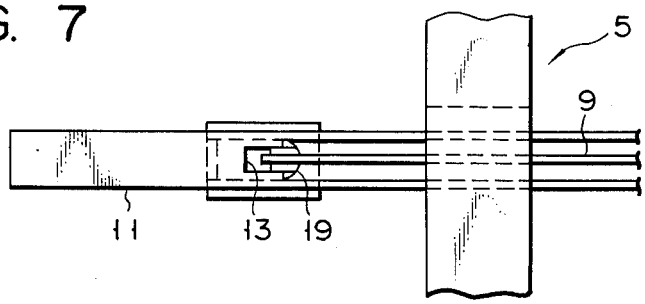
FIG. 7 is a plan view showing that portion of the stacking section which feeds the wires which have been stacked at the stacking section.

A first shaping apparatus for manufacturing spring units shown in FIGS. 1A, 1B, 2A and 2B has a frame body 1. Arranged at the upper portion of this body 1 is a stacking section 5 for stacking wire materials 27, as shown in FIGS. 2A, 2B, 3 and 4. More specifically, arranged at the upper portion of the frame body 1 are three mounting members 7 which are slanted a little toward the front side of the frame body 1 and on which the wires 27 are mounted, as shown in FIGS. 2A, 2B and 4. A keeping-down member 9 is arranged above each of the paired mounting members 7 located at a peripheral region of the frame body 1 in the longitudinal direction thereof, the keeping-down member 9 extending along the mounting member 7 with a gap therebetween. As shown in FIGS. 5 and 7, one end of a delivery plate 11 having a cutaway portion 13 is fixed onto the front end of the mounting member 7. The front end of the keeping-down member 9 which corresponds to the cutaway portion 13 is provided with a recess 15, as shown in FIG. 3. The delivery plate 11 is slanted at substantially the same angle as that of the mounting members 7 at the upper side of the body 1, and the other end thereof is located on the surface of a rectangular receiving plate 17 which is positioned lower than the mounting members 7. The receiving plate 17 is fixed on the surface of an attaching plate 18. A projecting air cylinder 19 is located under the delivery plate 11 to correspond to the cutaway portion 13 thereof. A rod 21 of the air cylinder 19 is provided with a pushing body 25 which has a tapered surface 23. A plurality of wires 27 having a certain length is stacked to be freely rollable in a space between the mounting members and the keeping-down members 9. The wire 27 located at the foremost end is contacted with the end face of the delivery plate 11. When the projecting cylinder 19 is operated to lift its rod 21, and the wire 27 located above it which if then released from its abutment with the delivery plate 11 and rolls down on the delivery plate 11 to the receiving plate 17. First sensors 28 which are arranged at the receiving plate 17, as shown in FIGS. 1A and 1B detect the rolling of the wires 27 on plate 17. Arranged outside the paired mounting members 7 at the upper portion of the body 1 are guide plates 29 for preventing the wire 27 from shifting in the axial direction thereof.

Figure 6:
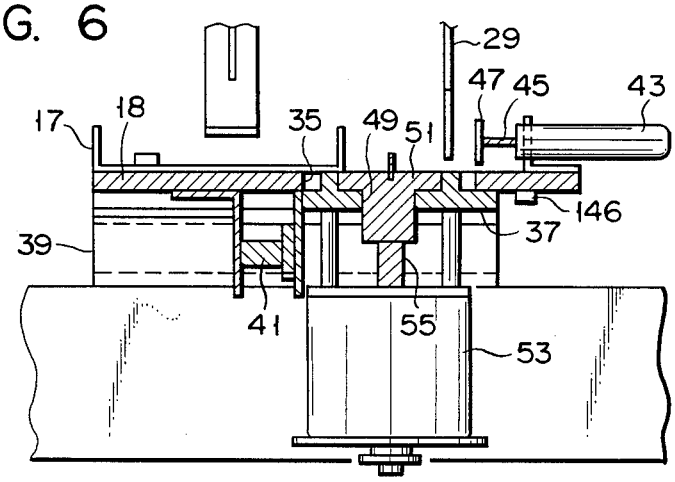
FIG. 6 is a sectional view taken along a line VI—VI in FIG. 3.

Stoppers 33 for preventing the wire from rolling out from the receiving plate 17 are located on the front region of the body 1, as shown in FIGS. 1A and 1B. Bent portions 27*a* (see FIG. 23) are formed at both ends of the wire by means of a bending mechanism which will be described next. The attaching plate 18 is provided with a cutaway portion 35 opened at one side thereof and a part of a movable plate 37 is slidably fitted into the cutaway portion 35, as shown in FIGS. 3 and 4. The movable plate 37 is connected to a rod 41 of a driver cylinder 39 located under the attaching plate 18, as shown in FIG. 6, and is driven along the axial direction of the wire material 27 by means of a cylinder 39. A position determining cylinder 43 is arranged on the movable plate 37 and a pushing plate 47 for moving the wire material 27 in the longitudinal direction of this wire material 27 is attached to a cylinder rod 45. A circular hole 49 is provided in the movable plate 37 and a rotary plate 51 is fitted to be freely rotatable into the hole 49 and is kept at the same level as the attaching plate 18. A rod 55 of a first rotating cylinder 53 supported by the movable plate 37 is connected to the underside of the rotary plate 51. When the cylinder 53 operates, the rod 55 is adapted to rotate by a certain angle by 90°, for example. The rotation of the rod 55 or of the rotary plate 51 is detected by a first limit switch 54 shown in FIG. 4. A center pin 57 is fixed on the upper surface of the rotary plate 51 in the rotating center thereof, and a bearing 59 is also located eccentrically on the upper surface of the rotary plate 51 at a given interval from the center pin 57.

When the wire 27 is rolled down by the lifting cylinders 19 and comes onto the receiving plate 17, each end of the wire 27 enters between the center pin 57 and the bearing 59 on the rotary plate 51 after striking the stopper 33. The position determining cylinders 43 respond to a detection signal applied from the sensor 28 and press both ends of the wire 27 by means of their pushing plates 47, thereby enabling the wire 27 to be positioned in the axial direction thereof. Thereafter, the wire 27 is held by holding arms 61 which will be described later, and the rotating cylinders 53 operate to rotate the rotary plates 51 by 90°, so that the bent portions 27*a* (see FIG. 23) which will be described later can be formed at both ends of the wire 27 by the center pins 57 and the bearings 59. After the bent portions 27*a* are formed, the driving cylinders 39 operate to drive the movable plates 37 toward the center of the body 1, thereby causing the bent portions 27*a* to be easily released from between the center pins 57 and the bearings 59. The movement of the movable plates 37 is detected this time by the second limit switches 38 shown in FIG. 3.

Figure 8:
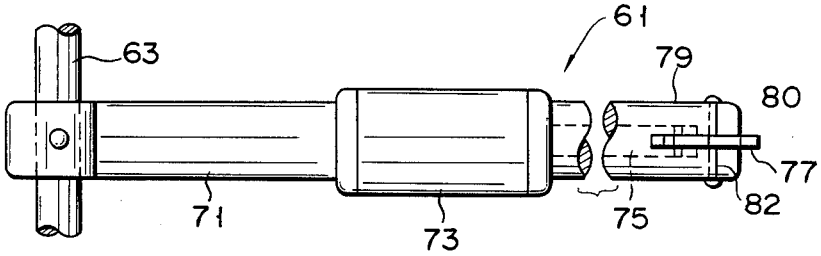
FIGS. 8 and 9 are plan and elevational views, respectively, showing a holding arm.
Figure 9:
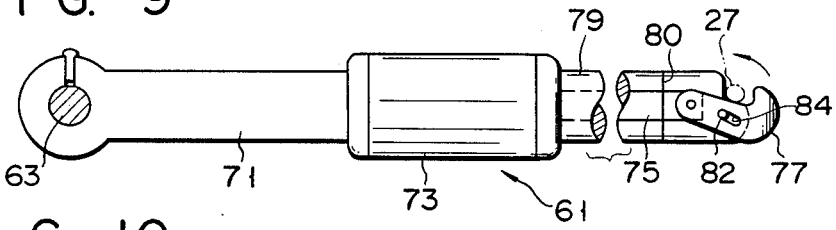

The wire 27 whose both ends have bent portions 27*a* is picked up from the upper portion of the frame body 1 by the paired holding arms 61 which form a picking-up mechanism. In short, an attaching axis 63 extends along the longitudinal direction at the upper front portion of the body 1. One end of the attaching axis 63 is supported to be freely rotatable, by a bearing 65, as shown in FIG. 2A. The other end thereof is connected to a rod 69 of a rotating cylinder 67, which is attached to the body 1, via a coupling 70. The attaching axis 63 is rotated by a certain angle, by 270°, for example, by the second rotating cylinder 67. The paired holding arms 61 are connected halfway to the attaching axis 63. As shown in FIGS. 8 and 9, the holding arm 61 comprises: a base 71 whose one end is fixed to the attaching axis 63; a driving cylinder 73 arranged at the other end of the base 71; a hook 77 pivoted to a rod 75 of the driving cylinder 73; and a sleeve 79 fitted onto the rod 75 and fixed to the cylinder 73. A groove 80 is formed at the front end portion of the sleeve 79, and a pin 82 erected in the groove 80 is inserted through a guide hole 84 of the hook 77. When the rod 75 of the driving cylinder 73 is retracted the hook 77 is swung in the direction shown by the arrow in FIG. 9. The paired holding arms 61 are located on the side of the upper portion of the frame body 1, holding the wire 27 until the bent portions **27*a* are formed at its both ends. When the bent portions 27*a* are formed at both ends of the wire 27, the second rotating cylinder 67 operates to rotate the arms 61 by about 270°. The wire 27 is thus positioned to face the front of the body 1**.

Figure 10:
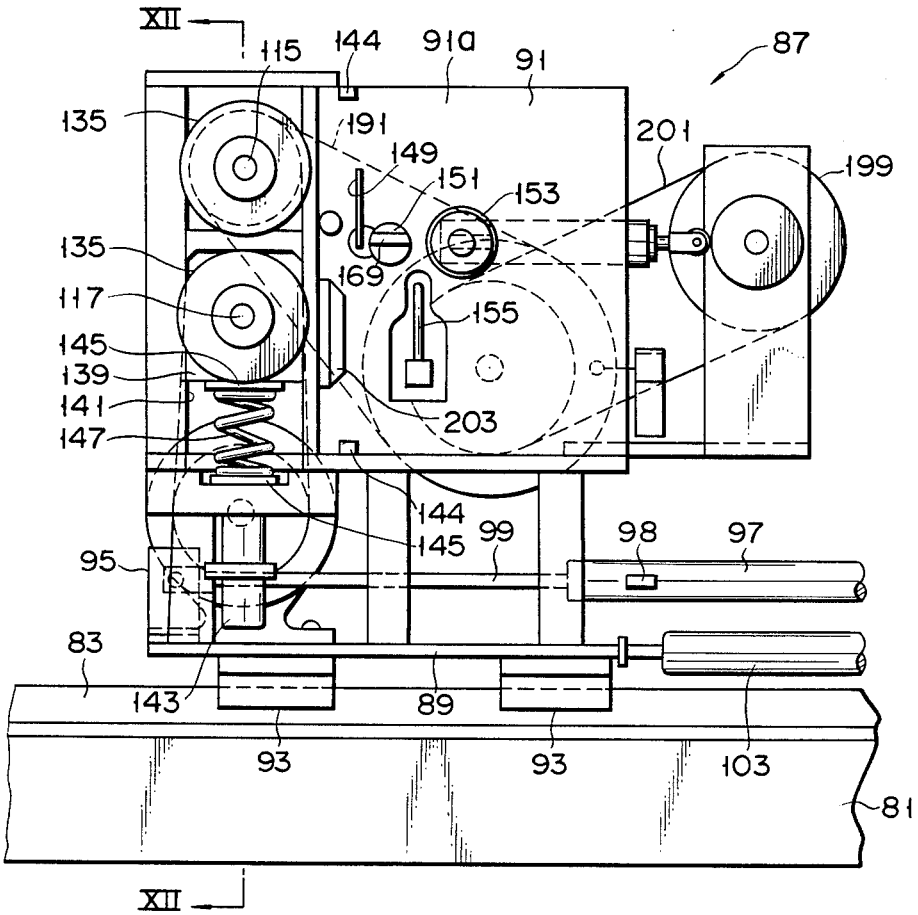
FIGS. 10 and 11 are expanded elevational and plan views, respectively, showing movable body 89 shown in FIGS. 2A and 2B.
Figure 12:
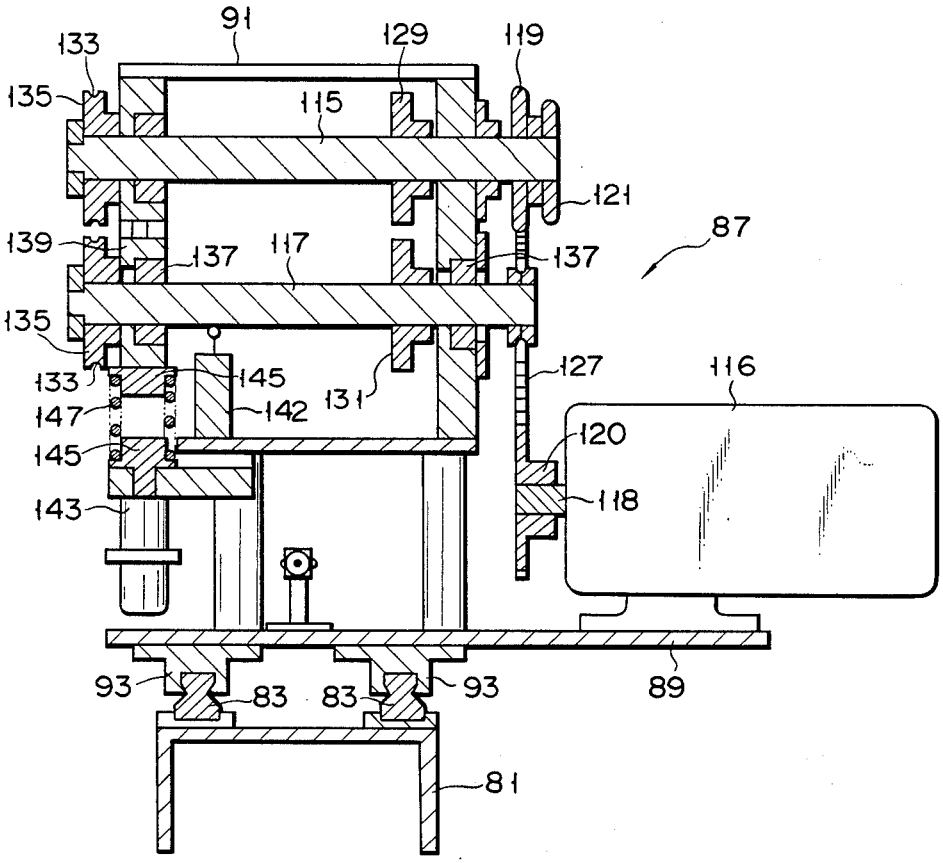
FIG. 12 is a sectional view taken along a line XII—XII in FIG. 10.

As shown in FIGS. 2A and 2B, a channel-like traverse member 81 is suspended at the front of the body 1 along the longitudinal direction thereof. A pair of guide rails 83 are laid, parallel to each other, on the traverse member 81. A pair of movable bodies 87 are mounted to be freely movable on the guide rails 83. More specifically, the movable body 87 comprises a base plate 89 and an upper casing 91 attached to the base plate 89, and pedestals 93 engaged to be freely slidable, with the guide rails 83 arranged under the base plate 89, as shown in FIGS. 10 and 12. Further, a connecting member 95 is arranged on the base plate 89. A rod 99 of a driving cylinder 97 located above the traverse member 81 is connected to the connecting member 95. The driving cylinder 97 is supported by an attaching member 101 mounted on the end portion of the traverse member 81. When the paired movable bodies 87 are driven toward each other along the guide rails 83, as will be described later, the rod 99 of the driving cylinder 97 is extended. When this rod 99 is extended by a certain length, it is detected by a reed switch 98 arranged at the cylinder 97 shown in FIG. 10. The rod 99 is operated only in the direction in which it enters into the cylinder 87, and the paired movable bodies 97 are movable toward or away from each other. When the movable bodies 87 return to their predetermined positions, the end faces of the base plates 89 contact buffers 103 mounted on the traverse member 81, thereby enabling the interval between the paired movable bodies 97 to be maintained.

Figure 11:
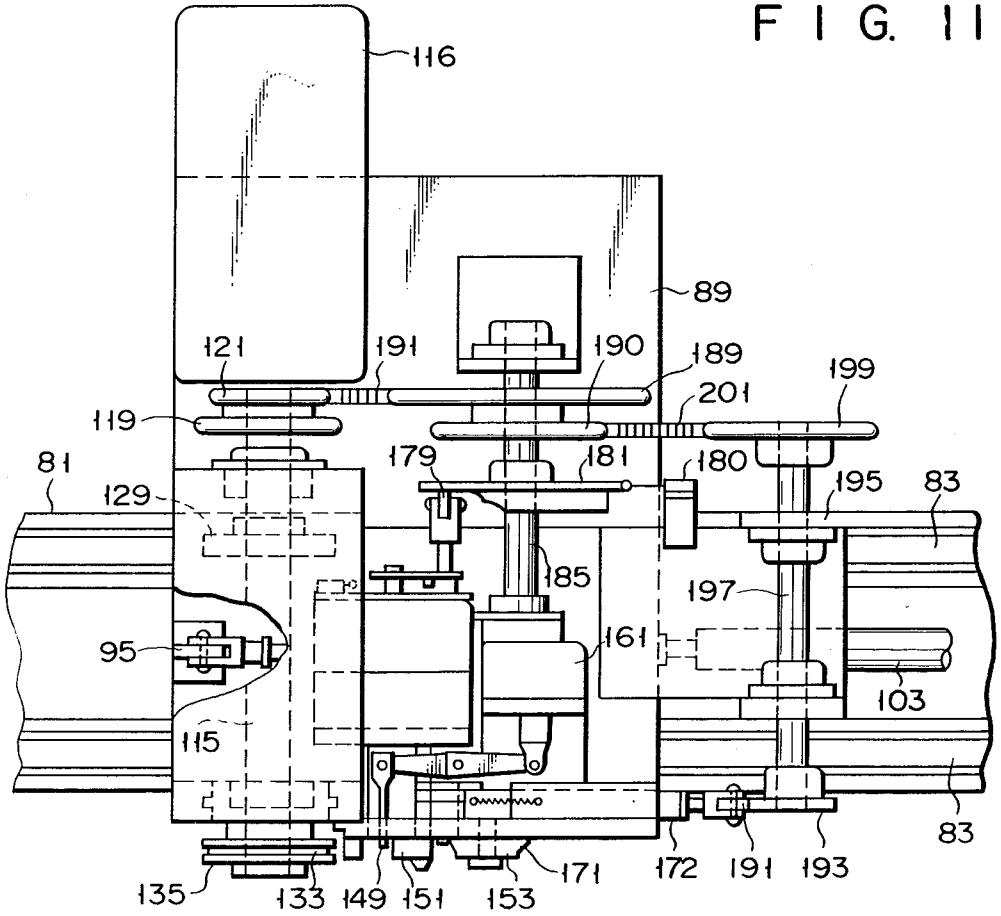
Figure 13:
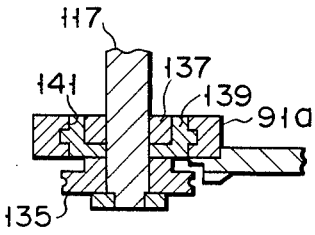
FIG. 13 is a sectional view showing the arrangement of securing a holding roller shown in FIG. 12.
Figure 22:
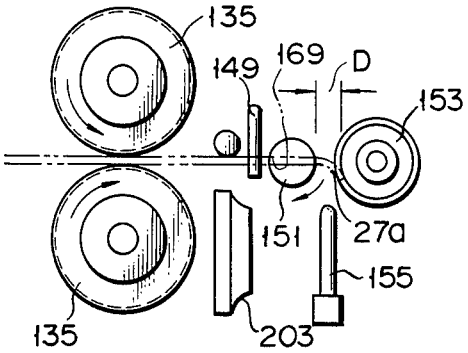
FIG. 22 is a front view showing in enlarged scale a part of a pair of movable bodies 89 shown in FIG. 10.

On the other hand, first and second shafts 115 and 117 (FIG. 12) which extend from the front to the back of the upper casing 91 are supported to be freely rotatable, by the casing 91. First and second sprocket wheels 119 and 121 are fitted onto that one end of the first shaft 115 which is projected from the back of the casing 91. A first chain 127 (FIG. 12) is stretched between the first sprocket 119 and a third sprocket wheel 120 which is fitted onto a rotating shaft 118 of a driving motor 116 mounted on the base plate 89. First and second gears 129 and 131 (FIG. 12), engageable with each other, are fitted halfway onto the first and second shafts 115 and 117, respectively. As shown in FIGS. 11 and 12, fitted onto those other ends of the first and second shafts 115 and 117 which are projected from the front of the upper casing 91 are holding rollers 135, each of which has a groove 133 on its outer circumference. The paired holding rollers 135 are vertically separated from each other by an interval which is larger than the diameter of the wire 27, and this interval between the paired holding rollers 135 is made narrower by swinging the other end of the second shaft 117 upward. In short, one end of the second shaft 117 is supported to be freely swingable by the upper casing 91 through self-aligning bearings 137. One of the self-aligning bearings 137 which supports the one end of the second shaft 117 is held by a slider 139, which is inserted to be freely slidable into a slide groove 141 vertically formed in a front plate **91*a* of the upper casing 91, as shown in FIG. 13. A lifting cylinder 143 is arranged at the lower end of the slide groove 141. Pedestals 145 are attached to a rod (not shown) of the cylinder 143 and the lower end face of the slider 139, respectively, and a compression spring 147 is interposed between the pedestals 145. When the lifting cylinder 143 operates to compress the compression spring 147, the slider 139 is lifted due to the restoring force of this compression spring 147 to thereby swing the second shaft 117. The swinging of this second shaft 117 is detected by a third limit switch 142 shown in FIG. 12. The lifting cylinder 143 operates after the paired holding arms 61 are rotated 270° from the upper portion to the front of the body 1 by means of the rotating cylinder 67. Namely, when the holding arms 61 are rotated and both end portions of the wire 27 are inserted between the holding rollers 135 on the paired movable bodies 87 separated from each other, the lifting cylinders 143 operate to lift the lower holding rollers 135. Therefore, both end portions of the wire 27 are caught in the grooves 133 of the two pairs of the holding rollers 135. The first and second gears 129 and 131 are engaged with each other at this time. The bent portions 27*a* which have been formed at the both ends of the wire 27 are directed downward, as shown in FIG. 22. When both end portions of the wire 27 are inserted between the paired holding rollers 135, respectively, they are detected by a pair of second sensors 144 shown in FIG. 10. Thereafter, the second rotating cylinder 67 operates to rotate the holding arms 61 reversely by 270° and return them to their original positions. The return of the holding arms 61 is detected by a fourth limit switch 146** shown in FIG. 1B.

Figure 14:
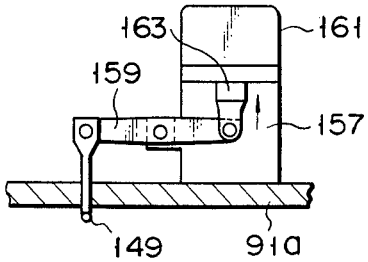
FIG. 14 is a plan view showing the arrangement of attaching a projecting pin shown in FIGS. 10 and 11.
Figure 15:
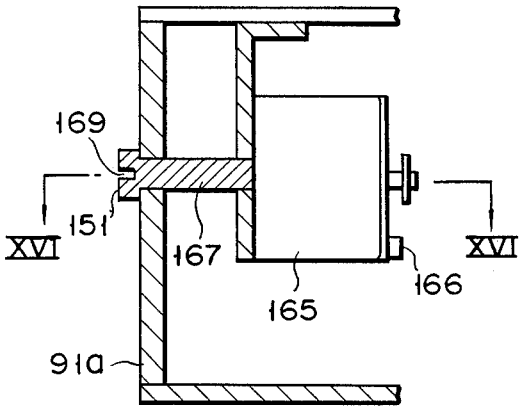
FIG. 15 is a sectional view showing the arrangement of attaching a guide body shown in FIG. 10.
Figure 16:
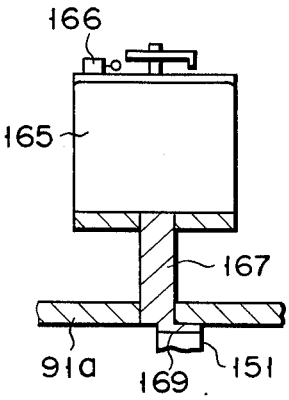
FIG. 16 is a sectional view taken along a line XVI—XVI in FIG. 15.
Figure 17:
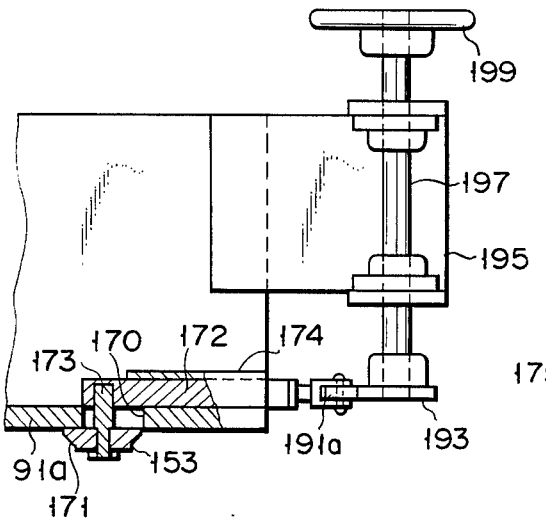
FIG. 17 is a sectional view showing the arrangement of attaching a shaping roller shown in FIG. 10.
Figure 18:
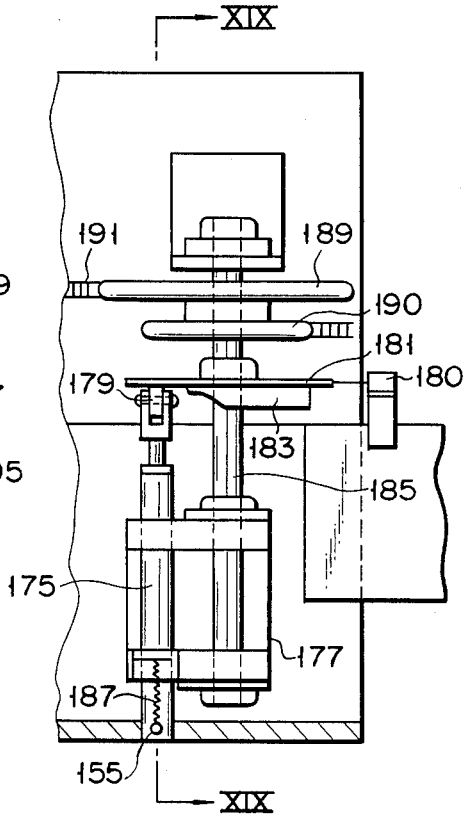
FIG. 18 is a plan view showing the arrangement of attaching a pitch rod shown in FIG. 11.
Figure 19:
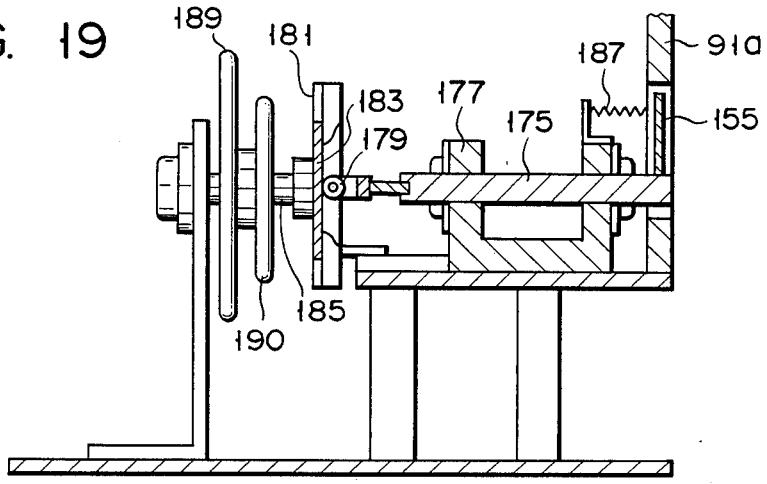
FIG. 19 is a sectional view taken along a line XIX—XIX in FIG. 18.
Figure 24:
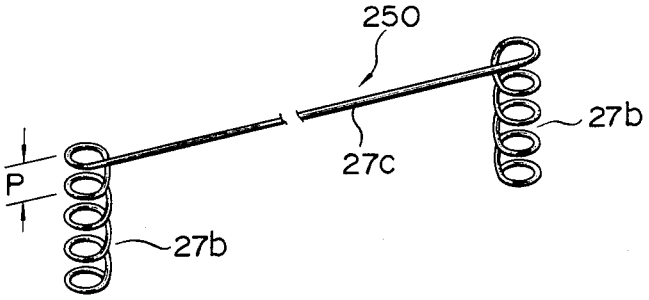
FIG. 24 is a perspective view showing a spring unit having coil springs formed at both ends thereof.
Figure 25:
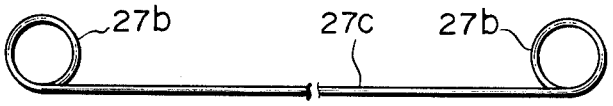
FIG. 25 is a plan view showing the spring unit having coil springs formed at both ends thereof.
Figure 26:
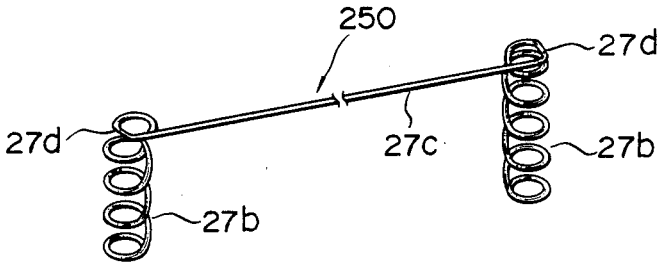
FIG. 26 is a perspective view showing a spring unit which has been completed by forming bent portions at both ends of the spring unit shown in FIGS. 24 and 25.

As shown in FIG. 10, a projecting pin 149, guide 151 and shaping roller 153 are arranged on the front plate **91*a* of the upper casing 91; and a pitch rod 155 is arranged between the guide 151 and the shaping roller 153. As shown in FIG. 14, the projecting pin 149 is connected to one end of a link 159 whose halfway portion is pivoted to a bracket 157 mounted on the inner face of the front plate 91*a* of the upper casing 91. The other end of this link 159 is pivoted to a rod 163 of an operating cylinder 161. Therefore, when the operating cylinder 161 operates to pull the rod 163 in the direction shown by the arrow in FIG. 14, the projecting pin 149 projects from the front plate 91*a*. The guide 151 is made like a disk and is fixed eccentrically to a rod 167 of a third rotating cylinder 165 housed in the upper casing 91, as shown in FIGS. 15 and 16. The guide 151 is provided with an insertion groove 169. When wire 27 is supplied between the paired holding rollers 135, both end portions of this wire 27** are inserted into the grooves 169, respectively. The guide 151 is rotated at an angle of about 90° by the third rotating cylinder 165. The rotation of this guide 151 is detected by a fifth limit switch 166 shown in FIG. 16. The third rotating cylinder 165 becomes operative after spiral spring portions 27*b* shown in FIG. 24 are formed at the both ends of the wire 27, as will be described later. The shaping roller 153 is provided with a guide face 171 formed on its outer circumference, as shown in FIG. 17, and it is supported to be freely rotatable, by an attaching rod 173 which is projected through a hole 170 formed in the front plate 91*a*. The attaching rod 173 is fixed to one end of a slider 172, which is held to be freely slidable, by a holder 174 attached to the inner face of the front plate 91*a*. Further, a pitch rod 155 is attached to one end of a projecting rod 175, as shown in FIGS. 18 and 19. The projecting rod 175 has a rectangular section and is supported to be freely slidable by a pedestal 177 housed in the upper casing 91, as shown in FIG. 18. Arranged at one end of the projecting rod 175 is a cam follower 179, which is in contact with a cam face 183 of a first cam 181, as shown in FIG. 19. The cam 181 is fitted onto a third shaft 185 supported to be freely rotatable by the pedestal 177. A tension spring 187 is interposed between the other end of the projecting rod 175 and the pedestal 177, thereby urging the cam follower 179 against the cam face 183 of the first cam 181. Furthermore, fourth and fifth sprocket wheels 189 and 190 are fitted onto the third shaft 185; and a second chain 191 is stretched between the fourth sprocket wheel 189 and the second sprocket wheel 121 fitted onto the first axis 115, as shown in FIG. 11. When the driving motor 116 becomes operative to rotate the first axis 115, the first cam 181 is rotated together with the first axis 115. The ratio of teeth between the second and third sprockets 121 and 189 is determined in such a way that the first cam finishes one rotation during the time period of forming the spiral spring portions 27*b* at the both ends of the wire 27. When the first cam 181 finishes its rotation, this is detected by a sixth limit switch 180.

A cam follower 191*a* is attached to be freely rotatable to the other end of the slider 172, as shown in FIG. 17. The cam follower 191*a* is urged against the circumferential cam face of a second cam 193 because the slider 172 is biased by a spring (not shown). The second cam 193 is fitted onto one end of a fourth shaft 197 which is supported to be freely rotatable by a pedestal 195. Fitted onto the other end of the fourth shaft 197 is a sixth sprocket wheel 199. A third chain 201 is stretched between the sixth and fifth sprocket wheels 199 and 190, as shown in FIG. 11. Therefore, the second cam 193 rotates together with the third shaft 115. When the second cam 193 rotates, the slider 172 is slid accordingly. The shaping roller 153 is thus shifted by this slider 172. Namely, the interval between the shaping roller 153 and the guide 151 can be changed. As shown in FIG. 10, a guiding member 203 is arranged on the front plate 91*a* of the upper casing 91 between the pitch rod 155 and the lower holding roller 135. The guiding member 203 prevents the spiral spring portion 27*b* from striking the holding rollers 135, as will be described later, when the guides 151 are rotated to form the bent portions 27*a* at the both ends of the wire 27 after the spiral spring portions 27*b* have been formed at each end.

Figure 20:
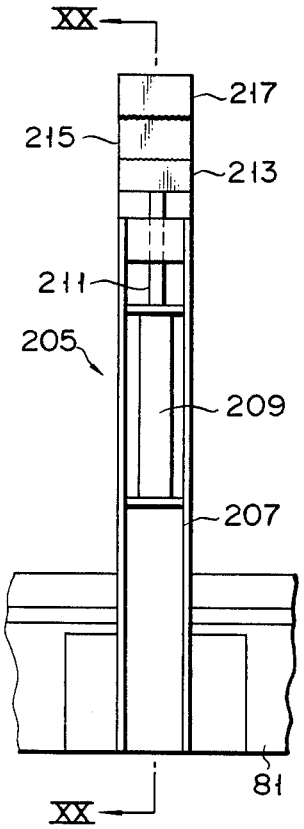
FIG. 20 is a front view showing a holding mechanism shown in FIG. 2B.
Figure 21:
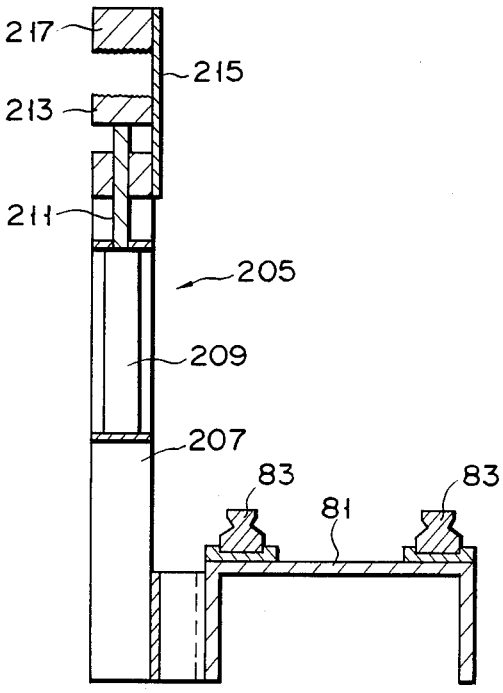
FIG. 21 is a sectional view taken along a line XX—XX in FIG. 20.

As shown in FIG. 2B, a holding mechanism 205 is arranged in the front center of the body 1 as viewed from the width of the body 1. The holding mechanism 205 has a support member 207 whose lower end is fixed to the traverse member 81, as shown in FIGS. 20 and 21. A clamp cylinder 209 is vertically held on the support member 207. A movable clamping piece 213 is attached to a rod 211 of the clamping cylinder 209. An attaching plate 215 is erected on the upper end of the support member 207, and a fixed clamping piece 217 which is located above the movable clamping piece 213 is attached to the attaching plate 215. When the clamping cylinder 209 operates to push the rod 211, the movable clamping piece 213 is brought into contact with the fixed clamping piece 217, so that the halfway portion of the wire 27 whose ends are held by the holding rollers 135 of the paired movable bodies 87 can be clamped between the movable and fixed clamping pieces 213 and 217, thereby preventing the wire 27 from shifting in the axial direction thereof.

Further, a delivery plate 221 which is shown by the broken lines in FIGS. 1B and 2B is arranged in the front center portion of the body 1. The wire 27 whose ends have been formed as spiral springs 27*b* falls onto the delivery plate 221 and is then delivered therefrom to the next process. A wire detecting switch 222 is arranged at the delivery plate 221 and detects the wire 27 which has fallen on the delivery plate 221.

Figure 23:
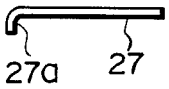
FIG. 23 is a plan view showing an end of the wire which has been bent to form a bent portion.

It will be now described how the spring units are manufactured by the above-described manufacturing apparatus. When a start switch on the operating panel (not shown) is turned ON, the pushing cylinders 19 are operated to send one of the wires 27 from the stacking section 5 to the delivery plate 11. The wire 27 rolls down onto the delivery plate 11 and strikes against the stoppers 33. The rolling of the wire 27 is detected at this time by the first sensors 28. The position determining cylinders 43, in response to the detection signal applied from the first sensors 28, determine the position of the wire 27 along the longitudinal direction of the body 1. Thereafter, the driving cylinders 73 for the holding arms 61 become operative to clamp the halfway portion of the wire 27 by their hooks 77. Then, the first rotating cylinders 53 are operated to rotate the rotary plates 51 by 90°, so that bent portions 27*a* are formed at both ends of the wire 27 by means of the center pins 57 and bearings 59 on the rotary plates 51, as shown in FIG. 23. The first rotating cylinder 53 is stopped when the first limit switch 54 is closed. When the bent portions 27*a* are formed at both ends of the wire 27 as described above, the driving cylinders 39 shown in FIG. 6 operate to drive the movable plates 37, thereby causing the bent portions 27*a* to be easily released from between the center pin 57 and the bearing 59. The movement of the movable plate 37 is detected by the second limit switch 38. The second rotating cylinder 67 shown in FIG. 1B responds to the detection signal, and the holding arms 61 are rotated by about 270°, so that both ends of the wire 27 can be inserted between the paired holding rollers 135, respectively, arranged on each of the movable bodies 87. When the presence of the wire is detected by the second sensors 144, the clamp cylinder 209 shown in FIGS. 2B, 20 and 21 operates to clamp and fix the wire 27 at its midpoint by means of the paired clamping pieces 213 and 217, thereby preventing the wire from shifting in the axial direction thereof. The lifting cylinder 143 shown in FIG. 12 arranged on each of the movable bodies 87 lifts the lower holding roller 135 so that it contacts the upper one. Each end of the wire 27 is held in the groove 133 between the upper and lower holding rollers 135. Next the presence of the wire is detected by the third limit switch 142 (see FIG. 12).

The holding arms 61 and the movable plates 37 are returned to their initial positions, in response to the detection signal applied from the third limit switches 142. When the return of the movable plates 37 to their initial positions is detected by the fourth limit switch 146 (see FIG. 1B), the driving motors 116 shown in FIG. 12 arranged on the paired movable bodies 87 operate in response to the detection signal supplied from the fourth limit switch 146. Because the holding rollers 135 are rotated and driven in the directions shown by the arrows in FIG. 22 by means of the motor 116, the wire 27 is thus fed from between the paired holding rollers 135. In short, the movable bodies 87 move toward each other, starting from the state under which they are separated from each other as shown in FIGS. 2A and 2B. As shown in FIG. 22, the bent portions 27*a* which have been formed at both ends of the wire 27 are thus put in contact with the outer circumferences of the shaping rollers 153, respectively, thereby enabling both ends of the wire 27 to be bent in a spiral. Since the bent portions 27*a* which have been formed at both ends of the wire 27 are directed downward at this time, both ends of the wire 27 itself are also bent downward. The diameter of the spiral is determined by the interval D between the guide 151 and the shaping roller 153, as shown in FIG. 22. When a spiral is formed in this manner at each end of the wire 27, the pitch rod 155 is projected forward from the front plate 91*a* of the upper casing 91, and pushes the spiral formed at each end of the wire 27. Since the third shaft 185 onto which the first cam 181 shown in FIGS. 18 and 19 is fitted is rotated by the running of the movable body 87, the cam follower 179 which is in contact with the cam face 183 of the first cam 181 moves from its bottom dead point to its top dead point to shift the projecting shaft 175, causing the pitch rod 155 to be gradually projected. Therefore, the spirals which are successively formed, following the movement of the paired movable bodies 87, after one spiral is formed at each end of the wire 27, are formed at a pitch P shown in FIG. 24 which is determined according to the projected amount of the pitch rod 155. When it is detected by the reed switches 98 that the rods 99 of the driving cylinders 97 have been projected by a certain length by the paired movable bodies 87 which have moved a predetermined distance, the driving motors 116 stop in response to the detection signal. Namely, the movable bodies 87 are stopped. Therefore, the formation of the spiral springs 27*b* each having a predetermined number of spirals is finished. The wire material 27 is thus formed as a spring unit 250 comprising a linear portion 27*c* and spiral spring portions 27*b* continuous from both ends of the linear portion 27*c*.

Figure 27:
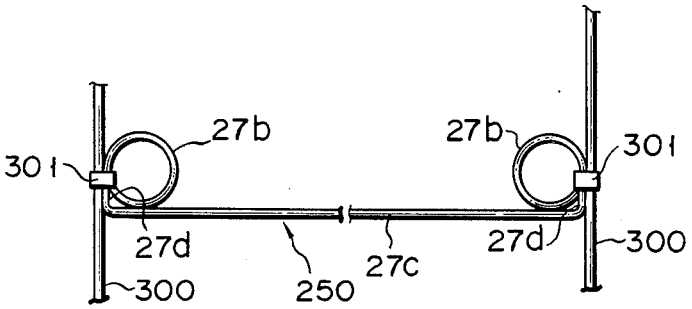
FIG. 27 is a plan view showing the spring unit incorporated into the mattress, said spring unit being the complete one shown in FIG. 26.

When the formation of the spiral spring portions 27*b* is finished, the third rotating cylinders 165 shown in FIG. 15 are made operative to swing the guides 151 90° in the direction shown by the arrow in FIG. 22. Both ends of the linear portion 27*c* which are inserted into the grooves 169 of the guides 151 are thus bent by about 90° to form linear bent portions 27*d* each continuous from the last spiral formed on the spiral spring 27*b*. This bent portion 27*d* is used to connect the spring unit to a frame 300 by means of a clip 301, as shown in FIG. 27. Namely, when a plurality of the springs 250 is assembled, combining their linear portions 27*c* with one another in a lattice pattern, they form a spring which is surrounded by a frame 300. The spring unit 250 is connected to the frame 300 by the clips 301 so that the frame 300 is linearly contacted with the linear portion 27*c*, thereby enabling a reliable connection to be attained between the spring unit and the frame.

When the bent portions 27*d* are formed at both ends of the linear portion 27*c* of the spring 250 and when the rotation of the guides 151 is detected by the fifth limit switches 166, the lifting cylinder 143 shown in FIGS. 10 and 12 operates in response to the detection signal applied from the fifth limit switch 166 to release the lower holding roller 135, thus separating the paired holding rollers 135 from each other. The clamp cylinder 209 is also operated to release the wire 27 from the clamping of the paired clamping pieces 213 and 217. The operating cylinder 161 shown in FIG. 11 is then operated to project the projecting pin 149. The linear portion 27*c* of the spring unit 250 is therefore pushed by the projecting pin 149, and the spring unit 250 falls on the delivery plate 221 located on the front side of the body 1. When this fall is detected by the proximity switch 222, the rods 99 of the driving cylinders 97 are driven in their retreating directions in response to the detection signal applied from the proximity switch 222; and the paired movable bodies 87 separate from each other by means of the driving motors 116 which are rotating reversely. These movable bodies 87 are thus returned to their initial positions. The first cam 181 is reversely rotated by 180° by the motor 116. This rotation is detected by the sixth limit switch 180. The above described process is again started in response to the detection signal applied from the sixth limit switch 180, and another spring unit 250 is formed from another piece of wire 27.

Figure 30:
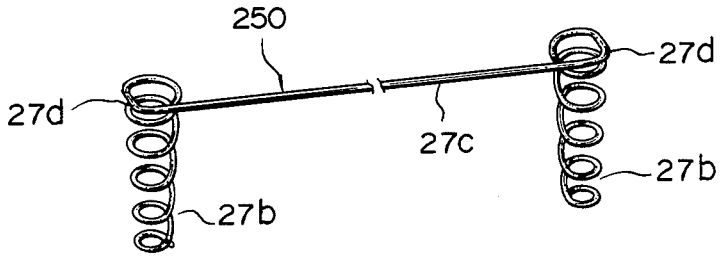
Figure 31:
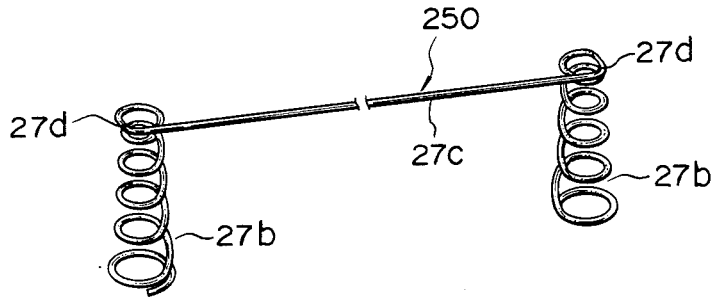

As described above, the diameter of the spring portion 27*b* can be changed by changing the interval D between the shaping roller 153 and the guide 151 shown in FIG. 22 at the time of forming the spirals 27*b* at the both ends of the wire 27. As shown in FIG. 17, the shaping roller 153 is made freely slidable by the slider 172. The cam follower 191 attached to the end of the slider 172 is urged against the second cam 193, and the interval D is therefore changed according to the shape of the cam 193, which is rotated by the driving motor 116 when the movable bodies 87 run toward each other. If the shape of the second cam 193 is set to change the interval between the shaping roller 153 and the guide 151 as shown by curve A in FIG. 28, the spiral spring 27*b* is shaped like a hand drum as shown in FIG. 29. When the interval is changed as in line B, the spiral spring 27 is shaped like a reverse cone as shown in FIG. 30; and when the interval is changed like line C, it is shaped like a cone as shown in FIG. 31. Namely, a spring having desired characteristics can be formed by optionally changing the shape of the spiral spring 27*b* by means of the cam 193.

When several reed switches 98 are arranged on the cylinder 92 and any one of these reed switches 98 can be selected by a changeover switch, the extended length of the rod 99, that is, the distance along which the movable bodies are moved can be selectively determined. The length of the linear portion 27*c* of the spring unit 250 formed can thus be varied. Similarly, it can also be varied by adjusting the initial length of the cylinder 97.

Figure 32:
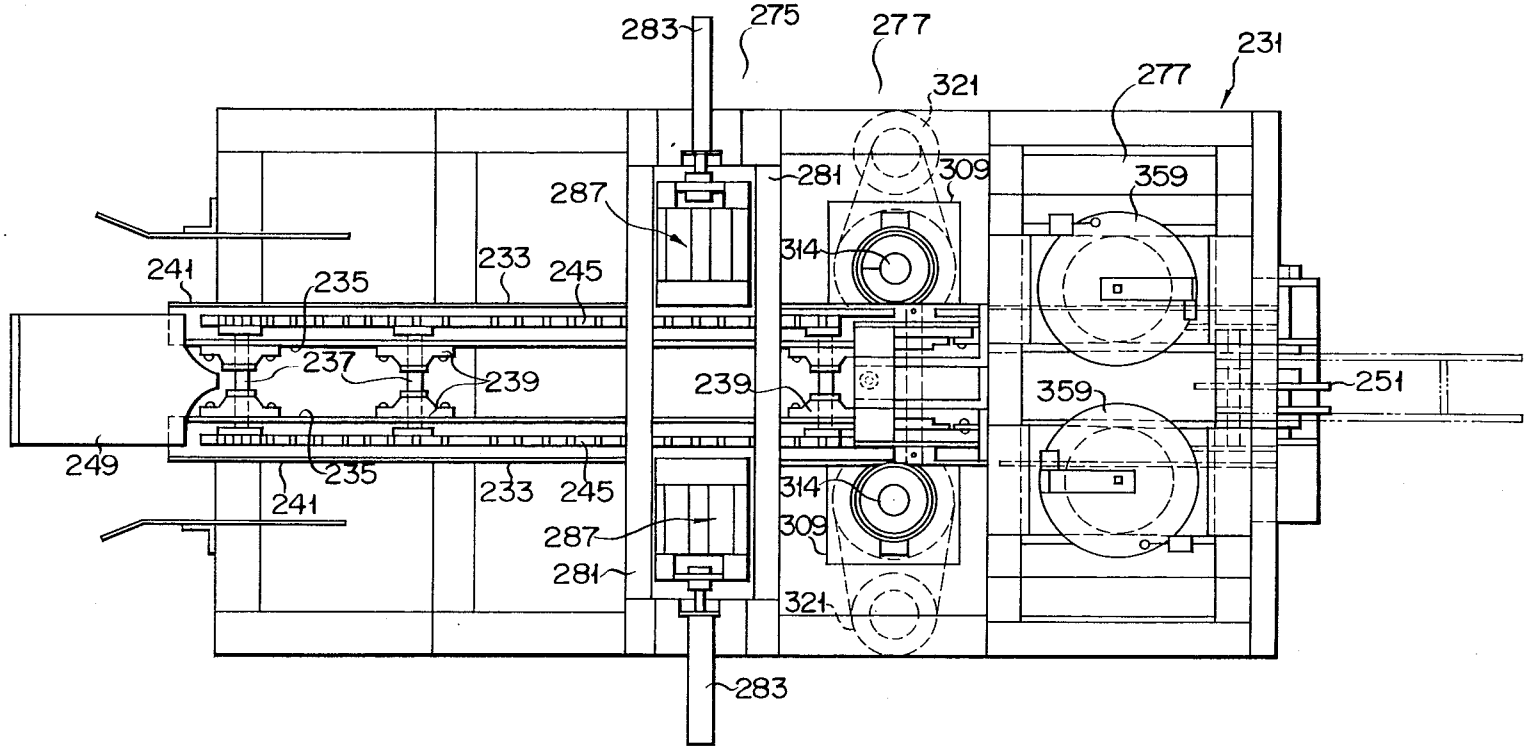
FIG. 32 is a plan view showing an apparatus according to the present invention to further shape the spring units.
Figure 33:
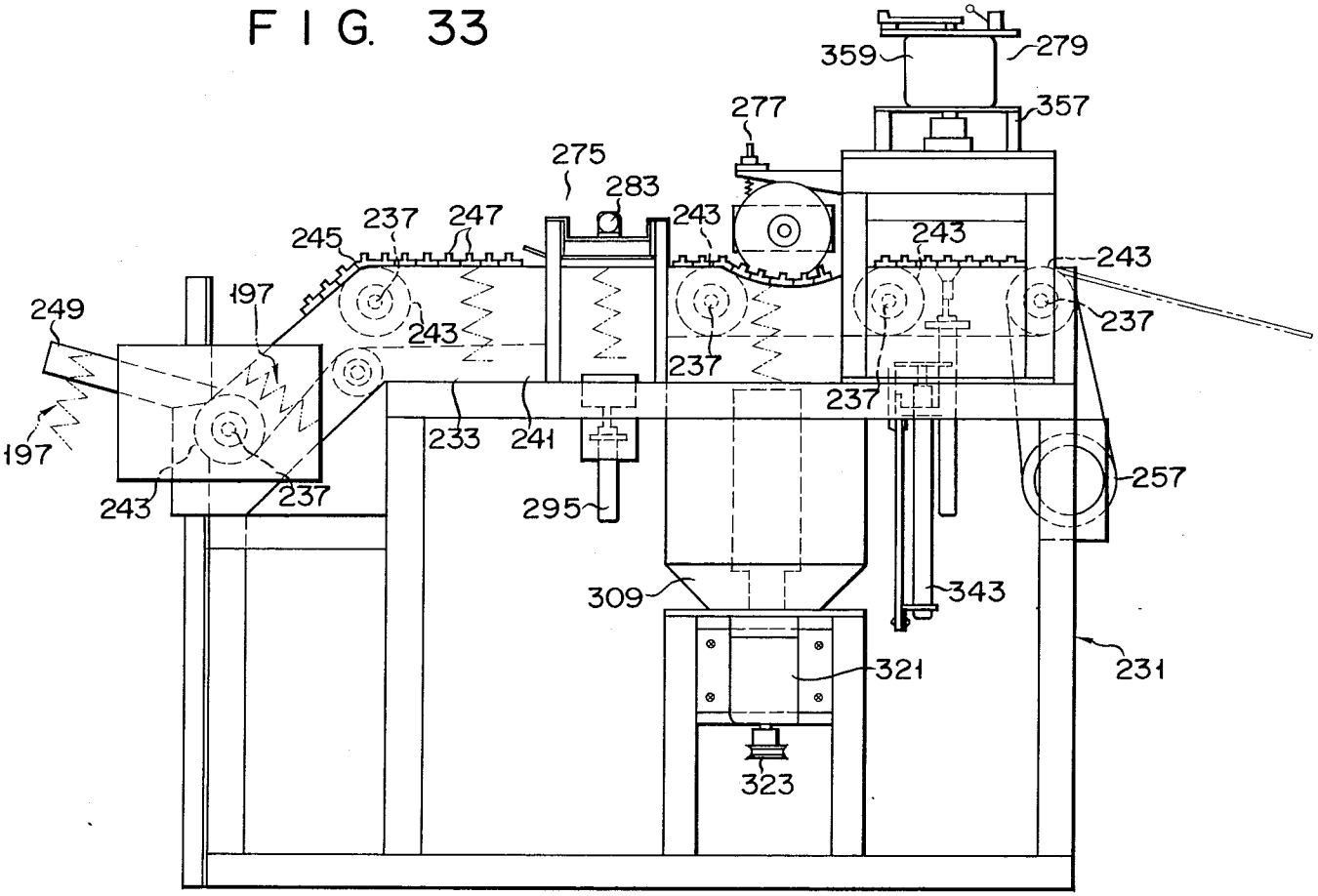
FIG. 33 is a side view showing the apparatus in FIG. 32.
Figure 34:
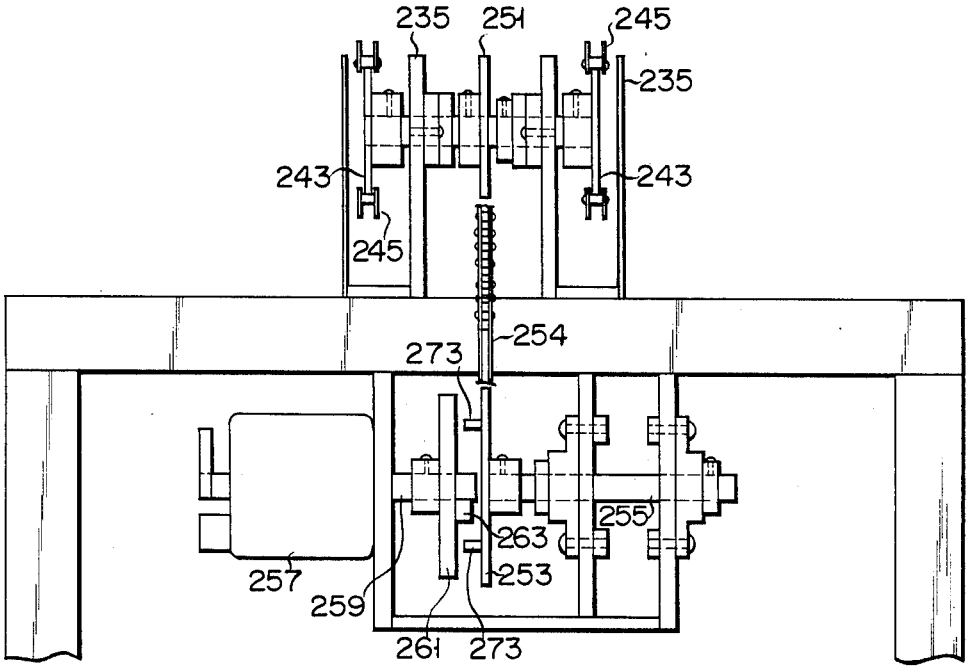
FIG. 34 is a front view showing a mechanism for driving a conveying chain employed by the second shaping apparatus shown in FIGS. 32 and 33.
Figure 35:
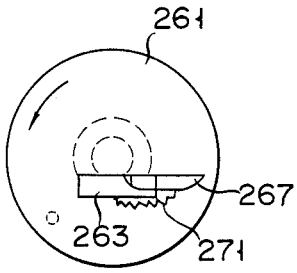
FIG. 35 is a front view showing a driving plate incorporated in the driving mechanism shown in FIG. 34.
Figure 36:
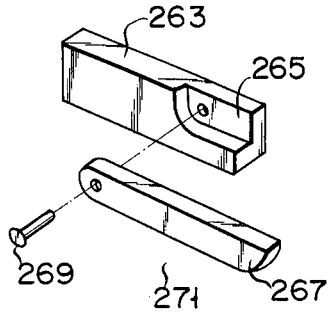
FIG. 36 is a perspective view showing an attaching member and an engaging rod dismantled, said attaching member and engaging rod being shown in FIG. 35.
Figure 47:
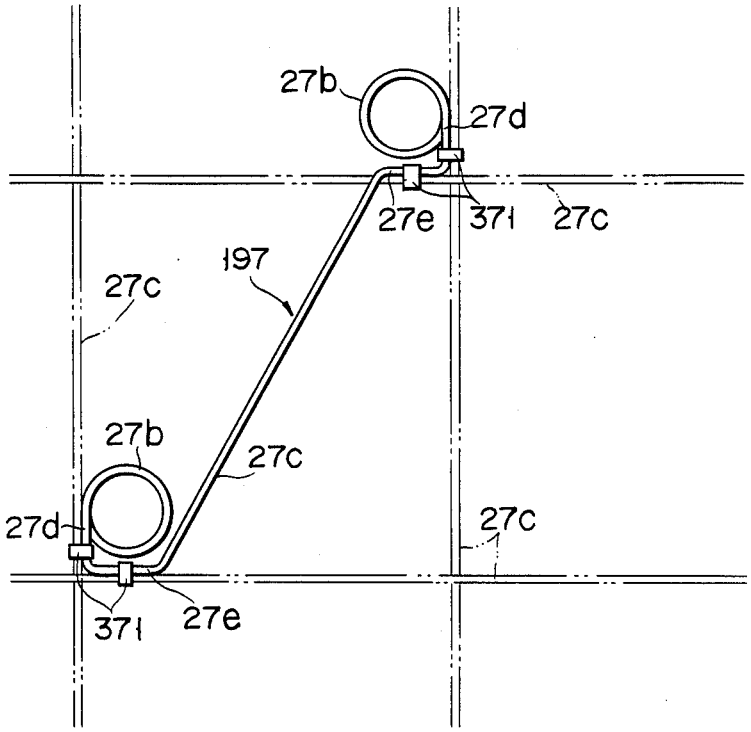
FIG. 47 is a plan view showing main and intermediate support springs connected.

In the case where the spring unit 250 formed by the apparatus shown in FIGS. 1A, 1B, 2A and 2B is further deformed to form an intermediate support spring unit 197, as shown in FIG. 47 for example, the spring unit 250 is dropped on the front side of the body 1 of the first shaping apparatus and is then delivered to a second shaping apparatus. This second shaping apparatus has a base 231, as shown in FIGS. 32 and 33. A pair of walls 233 having a reverse U-shaped section is erected on the base 231 so that they are separated by a certain interval. Several attaching rods 237 are supported to be freely rotatable by bearings 239 between the inner faces 235 of these walls 233. Sprockets 243 are fitted onto those portions of each of the attaching rods 237 which are located between the inner face 235 and the wall 233. Endless conveying chains 245 are stretched around the sprockets 243 located on both ends of the attaching rods 237, respectively. A tongue piece 247 is erected on each of plates of the chain 245. A receiving plate 249 is slanted relative to the chains 245 at one end of the base 231 as viewed lengthwise. The spring unit 250 formed by the first shaping apparatus drops onto the receiving plate 249. In short, the linear portion 27*c* of the spring unit 250 is received by the receiving plate 249. As shown in FIG. 34, an intermediate sprocket 251 is fitted onto the center portion of the attaching rod 237 located at the other end of the base 231. A driving sprocket 253 is located at the lower portion of the base 231, corresponding to the intermediate sprocket 251, and is fitted onto a shaft 255 which is supported to be freely rotatable by the base 231. A driving chain 254 is stretched between the driving sprocket 253 and the intermediate sprocket 251. The driving sprocket 253 is intermittently rotated at every predetermined angle by means of a driving cylinder 257. Namely, a driving plate 261 is fitted onto a rod 259 of the driving cylinder 257, separating it from and placing it opposite to the driving sprocket 253. An attaching member 263 shown in FIGS. 35 and 36 is fixed to the driving plate 261. A limiting recess 265 is formed at one end of the attaching member 263; and one end of an engaging rod 267 is supported to be freely rotatable in the limiting recess 265 through a pin 269. The other end thereof is projected radially and outwardly from the limiting recess 265, and a tension spring 271 is interposed between this other end and the attaching member 263 to urge the engaging rod 267. Further, a pair of pins 273 which are shifted from each other by 180° in the peripheral direction of the driving sprocket 253 is erected from the sprocket 253. When the driving cylinder 257 is operated to rotate its rod 259 by a predetermined angle or by 240°, for example, in the direction shown by the arrow in FIG. 35, and when the driving plate 261 is associated with this rotation of the rod 259, the engaging rod 267 is engaged with one of the pins 273 to rotate the driving sprocket 253. Although the engaging rod 267 strikes the other pin 273 when the driving plate 261 returns after having been rotated by the predetermined angle, the driving plate 261 is not rotated because only the engaging rod 267 rotates at this time. Namely, since the driving plate 261 is intermittently rotated by every predetermined angle only in one direction by means of the engaging rod 267, the conveying chain 245 runs endlessly, following the rotation of the driving plate 261. Therefore, the spring unit 250 which has been dropped on the receiving plate 249 is conveyed in such a way that the linear portion 27*c* thereof is engaged with the tongue pieces 247 of the conveying chains 245.

Figure 37:
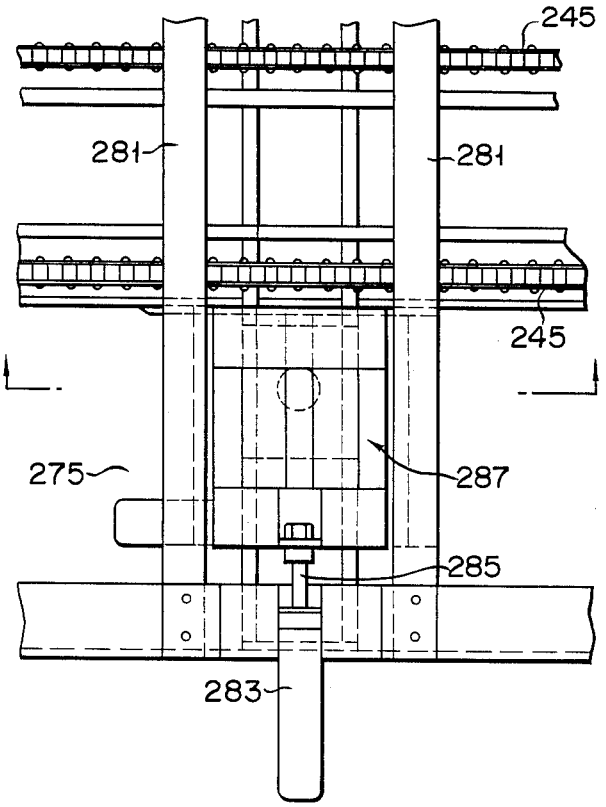
FIG. 37 is a plan view showing a hardening section in FIGS. 32 and 33.
Figure 38:
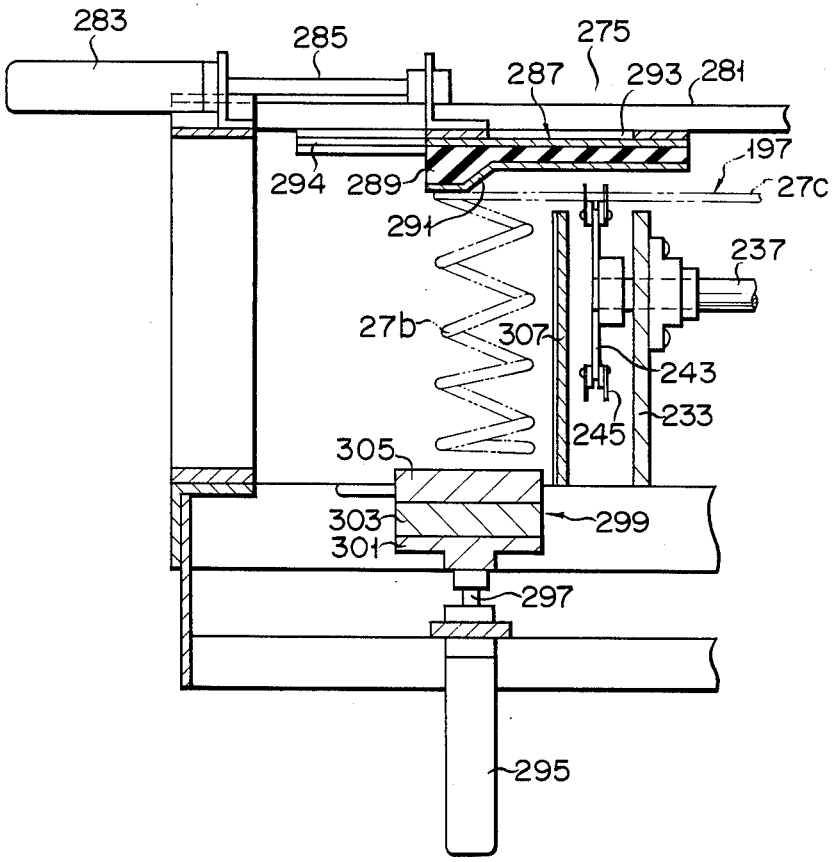
FIG. 38 is a side view showing the hardening section in FIG. 37.
Figure 39:
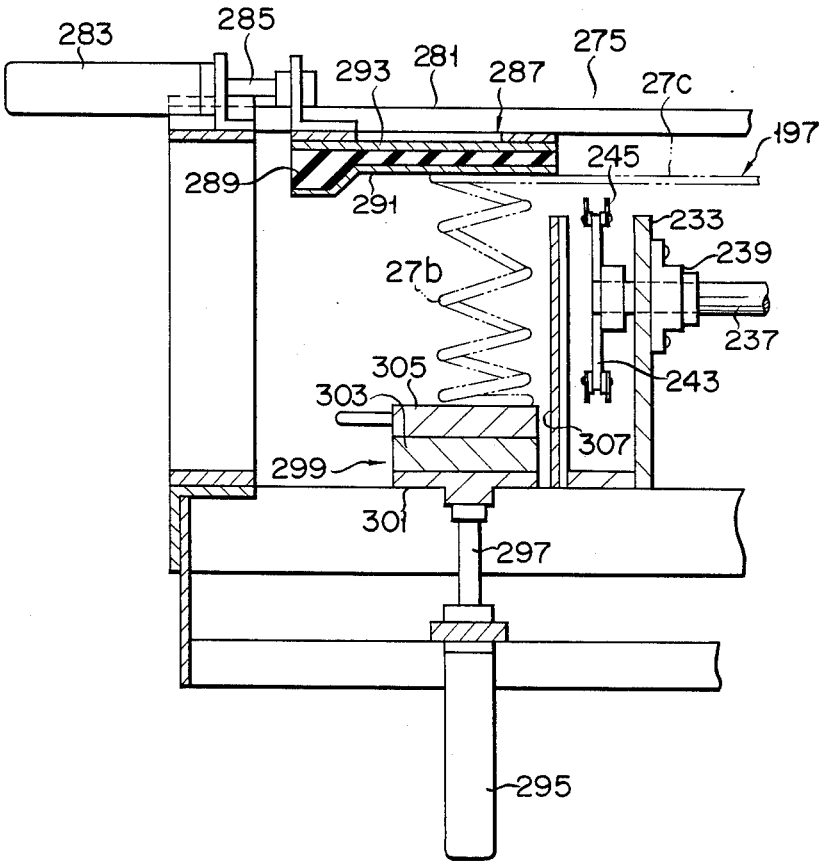
FIG. 39 is a side view showing the hardening section operating.

Hardening, coating and bend-processing sections 275, 277 and 279 are arranged successively on the base 231 along the direction of conveyance of the springs 250. The hardening section 275 has the arrangement shown in FIGS. 37 through 39. More specifically, a pair of traverse rods 281 is mounted on the base 231 and is mounted above the conveying chains 245 which cross the base 231, as shown in FIG. 32. Horizontal cylinders 283 are located at both ends of the traverse rods 281 whose rods 285 are kept horizontal. As shown in FIG. 38, an upper conductor 287 is attached to the rod 285. The upper conductor 287 has three-layers and is comprised by bonding an upper conductor plate 291 to the underside of an insulating material 289 and by bonding a guide plate 293 to the upper surface thereof. Both ends of the guide plate 293 are inserted to be freely slidable into guide grooves 294 formed in the traverse rod 281. The upper conductor 287 is usually located above the wall 233 or above and outside the wall 233 when the horizontal cylinder 283 is operated to retreat its rod 285. A vertical cylinder 295 is located outside and below the wall 233 to erect its rod 297 vertically. A lower conductor 299 is attached to the rod 297. The lower conductor 299 comprises fixing an attachment 301 to the rod 297 and bonding a lower conductor plate 305 onto the attachment 301 through an insulating material 303. The upper and the lower conductor plates 291 and 305 are connected to a power source (not shown). When the spring unit 250 is conveyed to the hardening section 275, the horizontal and vertical cylinders 283 and 295 are operated to hold each of the spirals 27*b* of the spring 250 between the upper and lower conductor plates 287 and 299, so that the upper and lower ends of each of the spirals 27*b* are contacted with the upper and lower conductor plates 287 and 299, respectively. Current thus flows to the spiral portions of each spring 27*b* to heat them.

Figure 40:
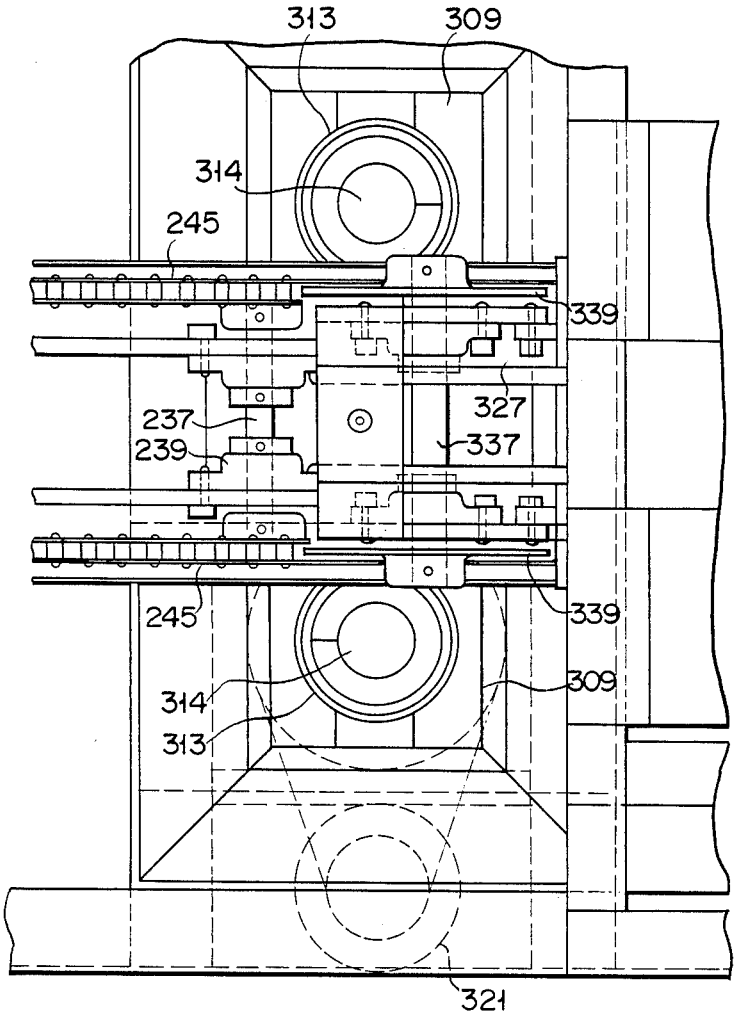
FIG. 40 is a plan view showing a coating section in FIGS. 32 and 33.
Figure 41:
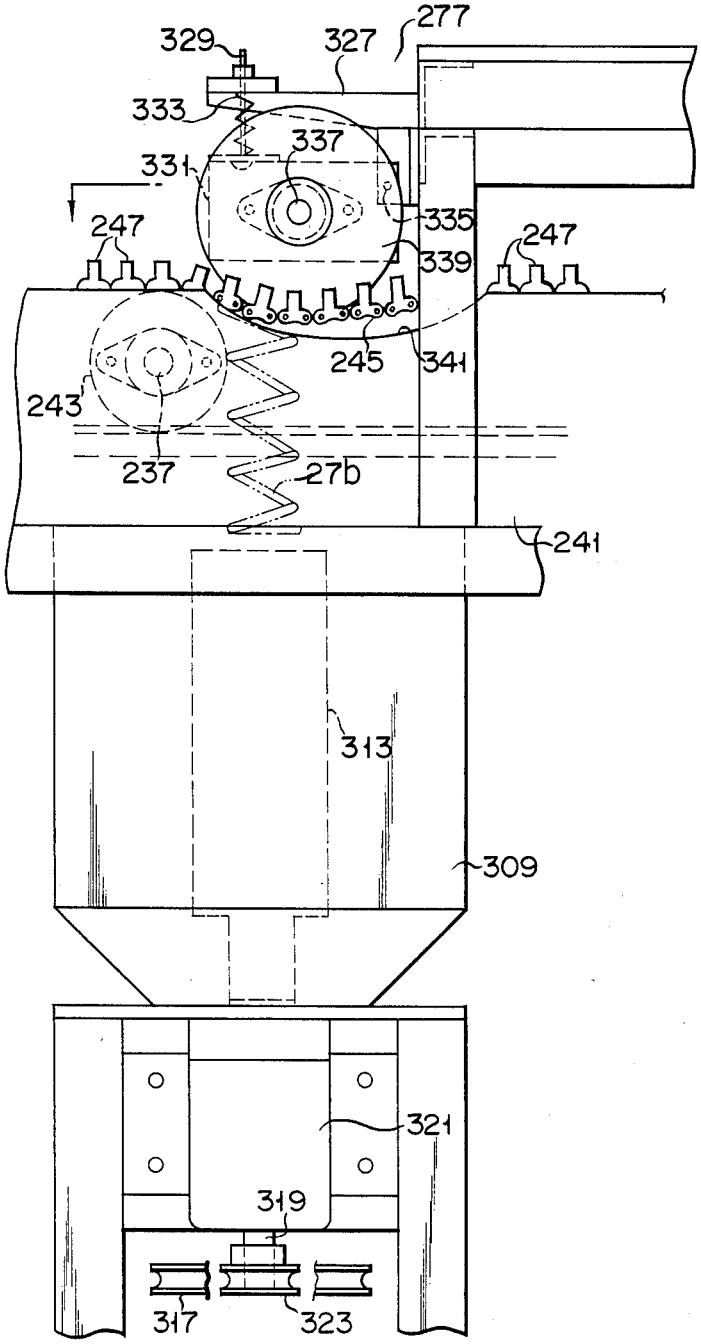
FIG. 41 is a side view showing the coating section.
Figure 42:
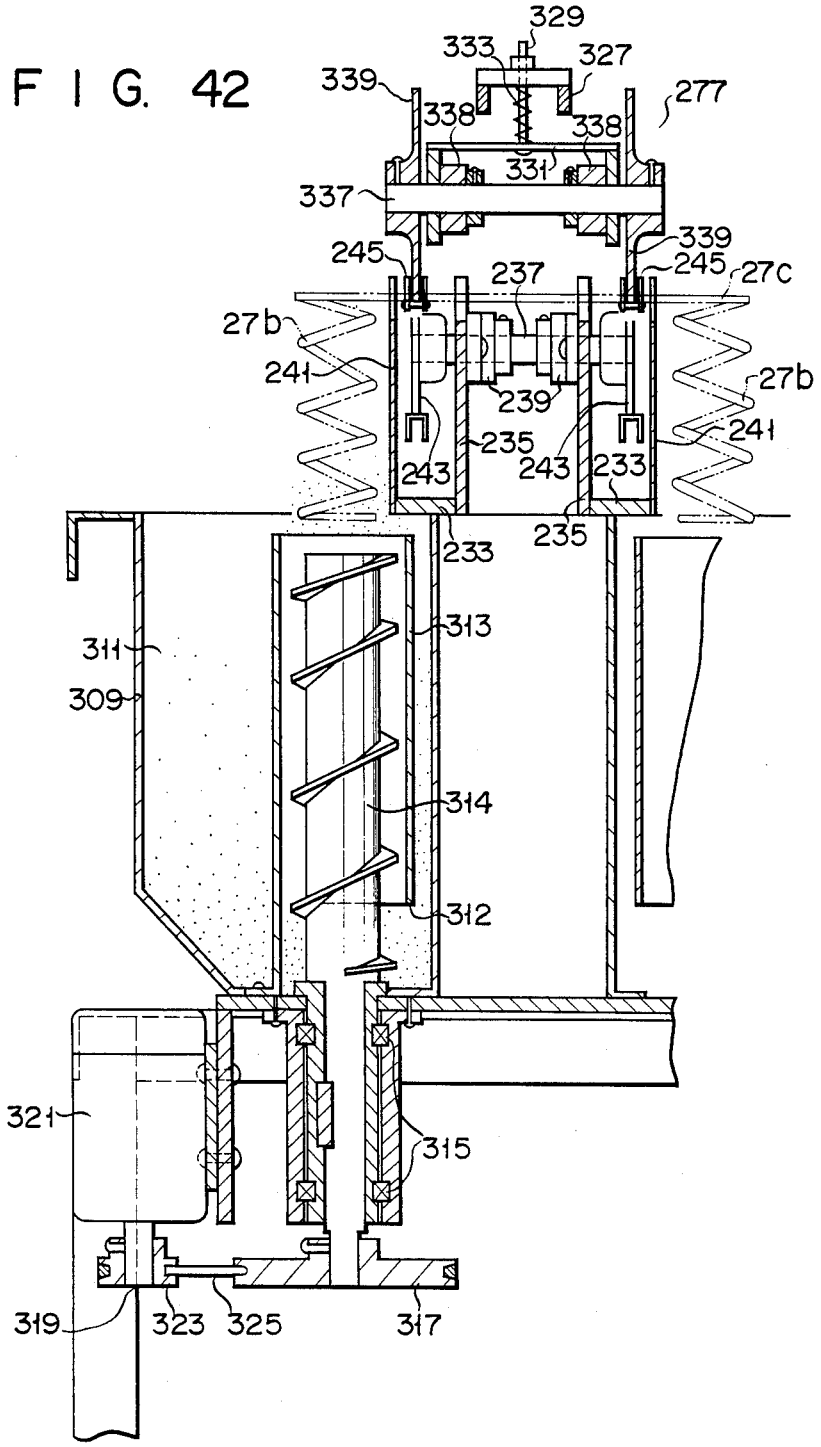
FIG. 42 is a longitudinally-sectioned view showing the coating section.
Figure 43:
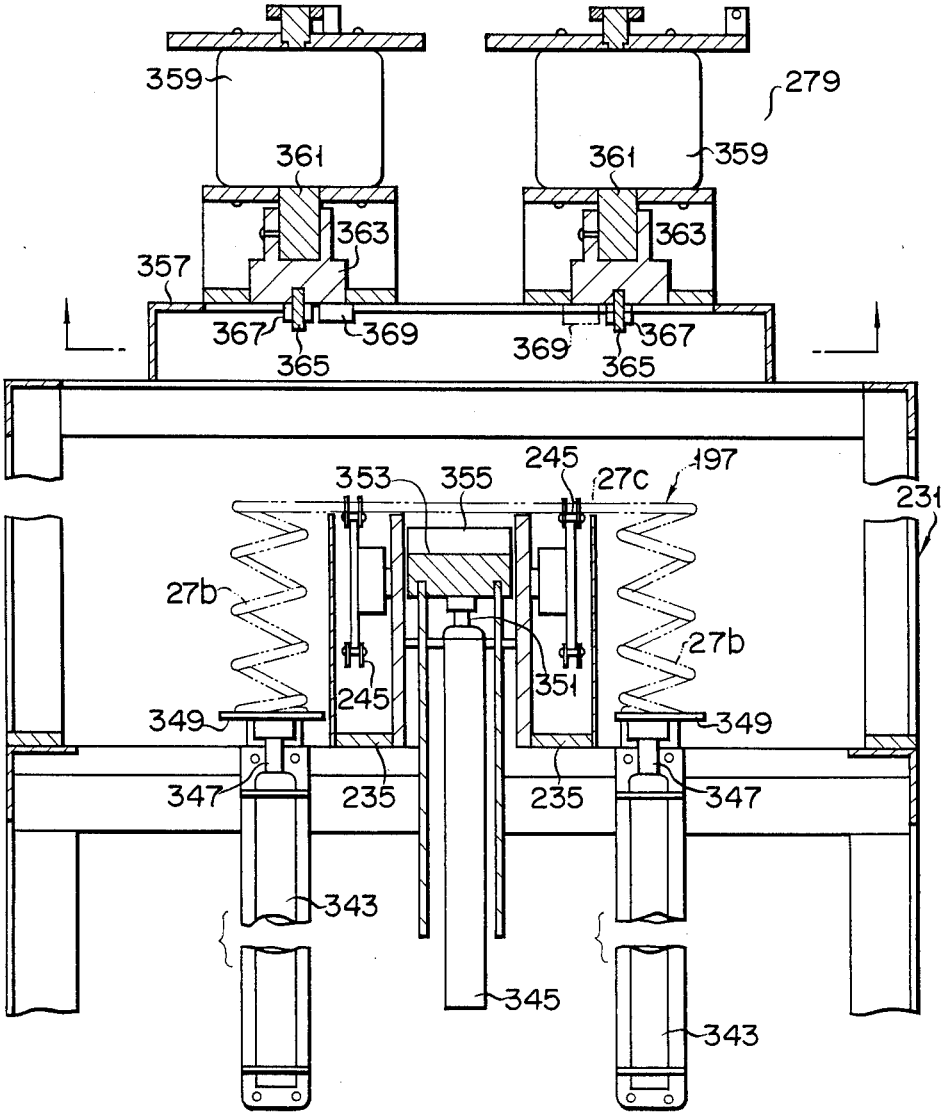
FIG. 43 is a longitudinally-sectioned view showing a bend-processing section in FIGS. 32 and 33.
Figure 44:
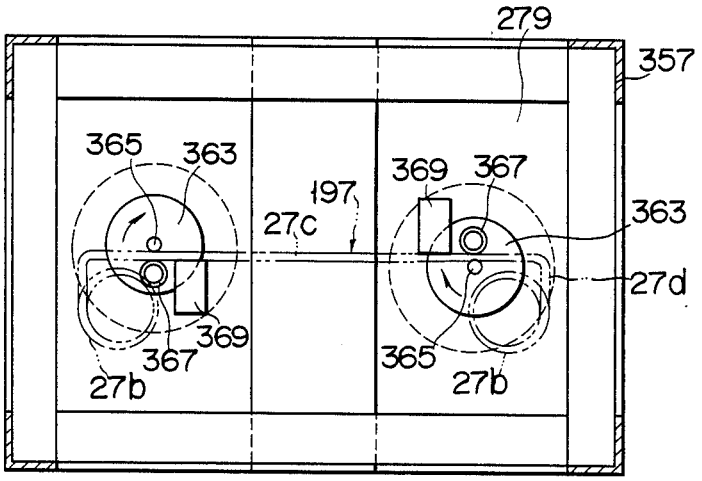
FIG. 44 is a plane view showing a pair of rotary bodies which form the bend-processing section.
Figure 45:
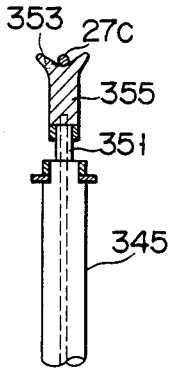
FIG. 45 is a side view showing a center cylinder.
Figure 46:
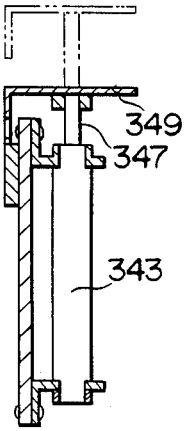
FIG. 46 is a side view showing a side cylinder.

The spring unit 250 which has been heated at the hardening section 275 is conveyed to the coating section 277, which has the arrangement shown in FIGS. 40 through 42. More specifically, a container 309 having an opening at the top is located below the walls 233. The container 309 contains the powder 311 of a synthetic resin, such as polyethylene, for example, as shown in FIG. 42. A cylindrical body 311 having an opening 312 formed along its side is erected at the bottom of the container, and houses a screw shaft 314. The lower end portion of the screw shaft 314 is projected through the bottom of the container 309 and is supported to be freely rotatable by bearings 315. A follower pulley 317 is fitted onto the lowermost end of the screw shaft 314. A motor 321 is located adjacent to the follower pulley 317, its rotating shaft 319 kept parallel to the screw shaft 314. A driving pulley 323 is fitted onto the rotating shaft 319 of the motor 321, and a belt 325 is stretched between these paired pulleys 317 and 323. When the screw shaft 314 is rotated by the motor 321, therefore, the powder 311 entering into the cylindrical body 313 through its opening 312 is urged upward by the screw shaft 314 and is blown upward through the top opening of the cylindrical body 313. Therefore, the heated spiral spring portions 27*b* of the spring unit 250 which pass above the cylindrical bodies 313 are subject to being coated by the powder 311. A bracket 327 whose one end is fixed to the base 231 is arranged above the walls 233 at the coating section 277. A screw rod 329 is attached to freely move up and down to the bracket 327, and an attachment 331 is elastically attached to the screw rod 329 through a spring 333. The attachment 331 is pivoted to the base 231 through a pin 335 at the one end thereof, and an attaching rod 337 is horizontally attached to the attachment and is rotatably supported by bearings 338. Fitted onto the both ends of the attaching rod 337 are push rollers 339, which push the conveying chains 245 to curve downward. When the spring unit 250 which is conveyed by the conveying chains 245 reaches the coating section 277, it is shifted downward together with the conveying chains 245 by the push rollers 339. The lower end of the spiral 27*b* of the spring 250 thus approaches the opening of the cylindrical body 313, thereby making it easier for the powder 311 to be deposited on the lower portion of the spiral 27*b*. Formed at those portions of the walls 233 which correspond to the push rollers 339 are recesses 341, which enable the spring unit 250 to be shifted downward together with the conveying claims 245. The spring unit coated with the synthetic resin can reduce a noise which is produced at use of a bed assembly by the spring units and can be firmly and reliably fixed to the frame by the tacker.

The spring unit 250 which has passed through the coating section 277 reaches the bendprocessing section 279, which has the arrangement shown in FIGS. 43 through 46. More specifically, a pair of lift side cylinders 343 is vertically arranged below the walls 233. A lift center cylinder 345 is vertically located between the paired walls 233. A first plate-like support 349 is fixed to a rod 347 of the lift side cylinder 343. A second support 355 having a Y-shaped receiving portion 353 is also fixed to a rod 351 of the lift center cylinder 345. A pair of the first supports 349 is placed opposite to the lower ends of the spirals 27*b* of the spring 250 which has been conveyed by the conveying chains 245; and a second support 355 is placed opposite to the linear portion 27*c* of the spring 250. When the cylinders 343 and 345 are operated, therefore, the spiral portions 27*b* and linear portion 27*c* of the spring unit 250 are supported by the first and second supports to float the spring unit 250 from the conveying chains 245. An attachment 357 is arranged above the cylinders 343 and 345, and a pair of bend-processing cylinders 359 are attached to the attachment 357, their rods 361 directed downward. A rotary block 363 is fixed to the rod 361 of each of the cylinders 359. A pin 365 is erected from the rotary block 363, adjacent to the rotating center of the block 363, and a roller 367 is located to be freely rotatable and adjacent to the pin 365 but is separated by a predetermined distance from the latter. When the spring unit 250 is lifted by the side and center lift cylinders 343 and 345, both ends of its linear portion 27*c* are held between the pin 365 and the roller 367. Pressing plates 369 which contact the opposite sides of both ends of the linear portion 27*c* of the spring unit 250 when both ends of the linear portions 27*c* are held between the pin 365 and the roller 367 are arranged at the attachment 357. After the side and center lift cylinders 343 and 345 are operated, the bend-processing cylinders 359 are rendered operative to rotate their rods 361 by a predetermined angle in the direction shown by the arrows in FIG. 44. Therefore, second bent portions 27*e* continuous from the first bent portions 27*d* are formed to be parallel to are another at both ends of the linear portion 27*c* of the spring 250, as shown in FIG. 47. In a case where a spring is formed by the main and intermediate spring portions, the first and second bent portions 27*d* and 27*e* are linearly contacted with the main spring units which are combined in a lattice pattern, and are connected thereto by clips 371.

The operation of the second shaping apparatus will be described. When the spring 250 which has been shaped by the first shaping apparatus is fed to the receiving plate 249 of the second shaping apparatus, the spring is conveyed by the conveying chains 245, and its linear portion 27*c* is held between the tongue pieces 247 of the chains 245. When the spring 250 conveyed by the conveying chains 245 reaches the hardening section 275, the horizontal cylinders 283 are rendered operative causing the upper conductors 287 to be opposite to the upper ends of the spiral portions 27*b*, as shown in FIG. 32. The vertical cylinders 295 then operate to lift the lower conductors 299. Therefore, the spring 250 is lifted to float its linear portion 27*c* from the conveying chains 245 while its spiral portions 27*b* are held between the paired conductors 287 and 299. Current is thus flowed to the spiral portions 27*b*, which are heated and hardened.

After this hardening is applied for a predetermined time period, the horizontal and vertical cylinders 283 and 295 return to their initial positions, and the spring 250 is again conveyed by the conveying chains 245. When the spring 250 reaches the coating section 277, the powder 311 blown up through the top opening of the cylindrical body 313 by the screw shaft 314 is deposited on the lower portions of the spiral portions 27*b* which have been heated at the hardening section 275. Therefore, the lower portions of the spiral portions 27*b* are coated by the powder 311.

When the spring 250 which has passed through the coating section 277 reaches the bend-processing section 279, the paired lift side cylinders 343 and the lift center cylinder 345 become operative to lift the spring 250. Both ends of the linear portion 27*c* of the spring 250 are thus held between the pin 365 and the roller 367 of each of the rotary blocks 363 which are fixed to the rods 361 of the bend-processing cylinders 359. The bend-processing cylinders 359 then operate to rotate their rods 361 by the predetermined angle. Therefore, the second bent portions 27*e*, each continuous from the first bent portion 27*d* which has been formed by the first shaping apparatus, are formed at both ends of the linear portion 27*c*.

When the second bent portions 27*e* are formed at both ends of the linear portion 27*c* of the spring unit 250, the lift side and center cylinders 343 and 345 return to their initial positions, and the spring 250 is fed from the second shaping apparatus by means of the conveying chains 245. The bend-processing cylinders 359 also return to their initial positions.

Figure 48A:
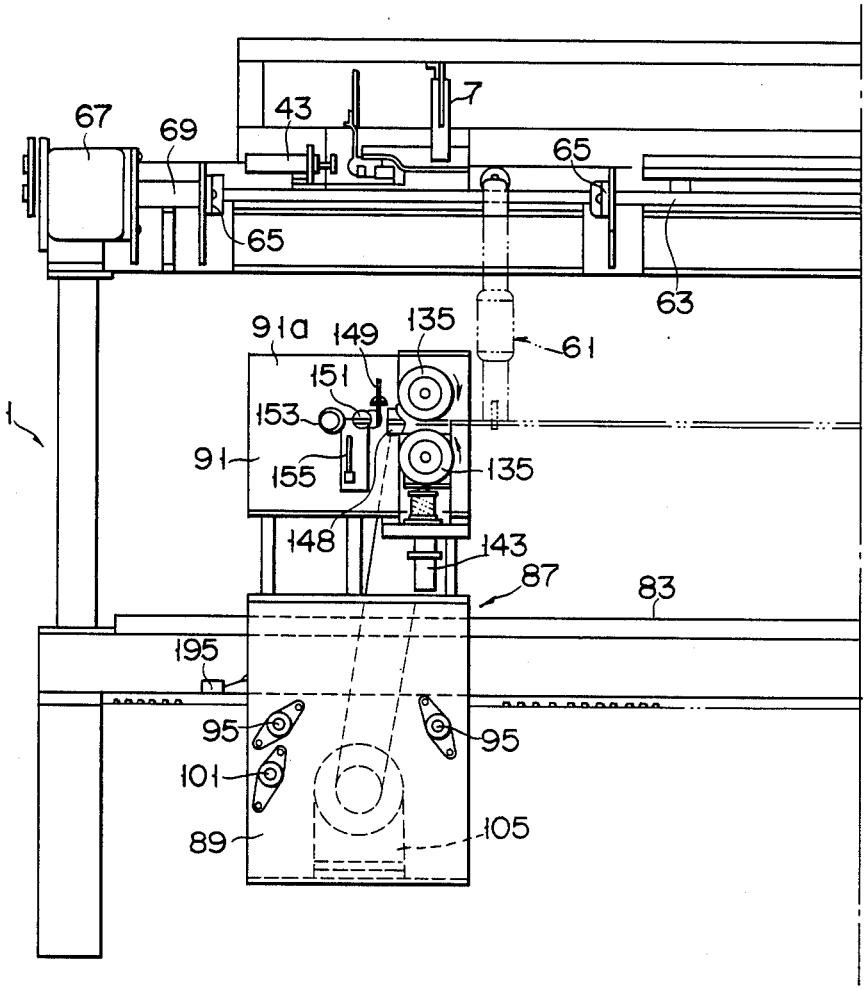
FIGS. 48A and 48B are plan views showing a second embodiment of a shaping apparatus for manufacturing spring units according to the invention.
Figure 48B:
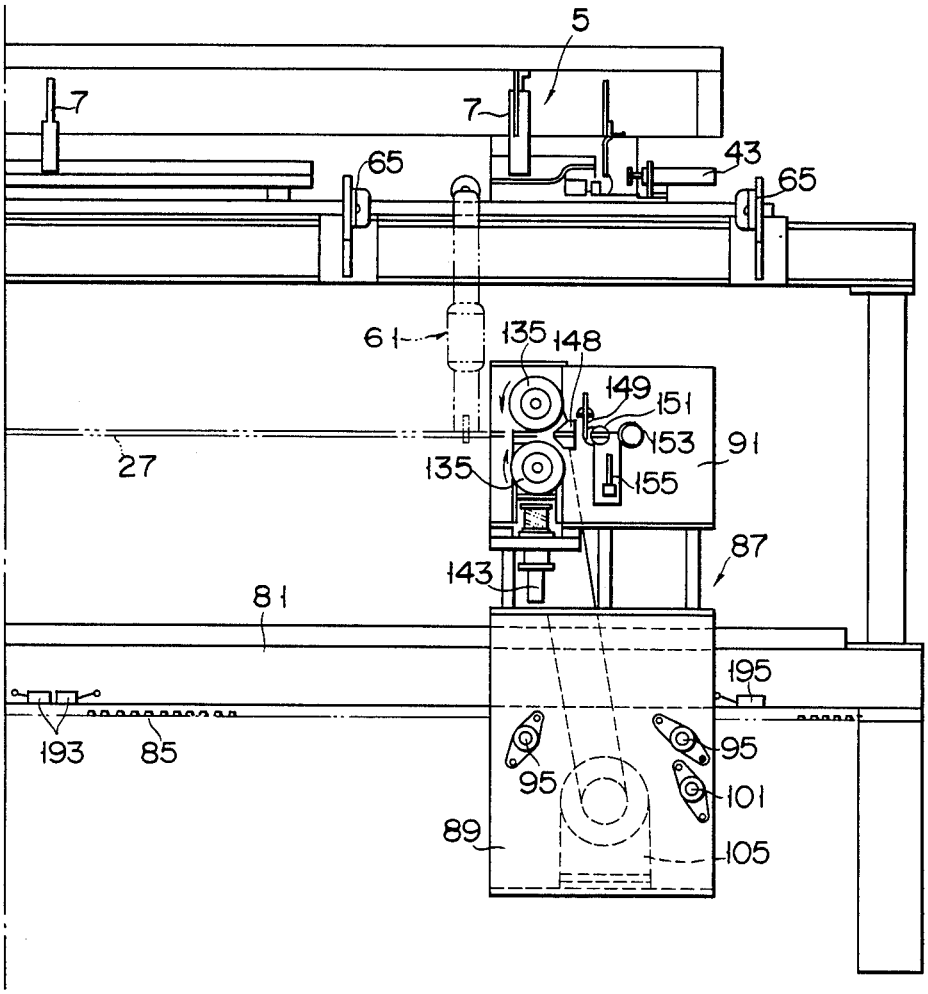
Figure 49:
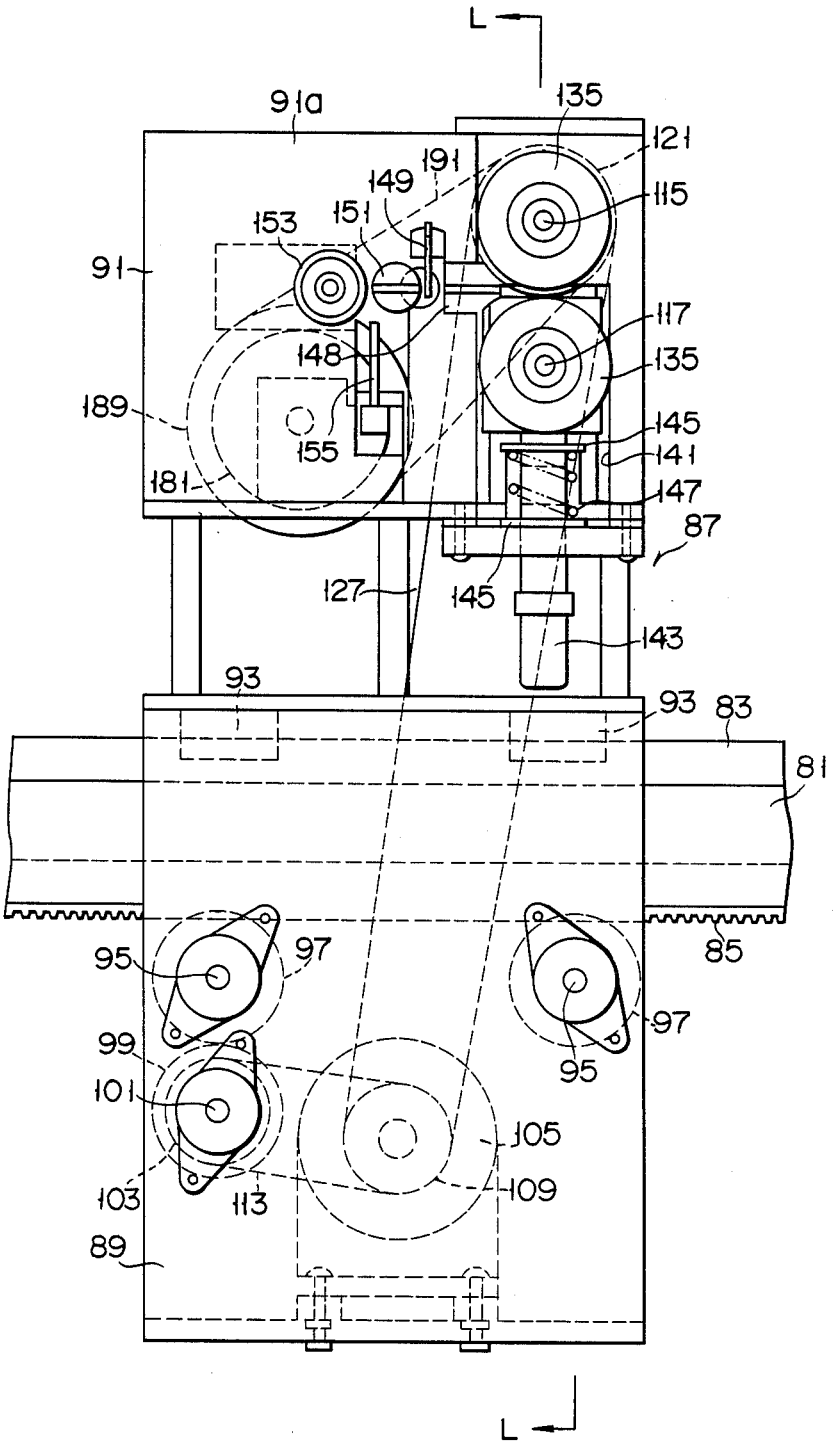
FIGS. 49 and 50 are front and plan views showing a movable body shown in FIGS. 48A and 48B.
Figure 50:
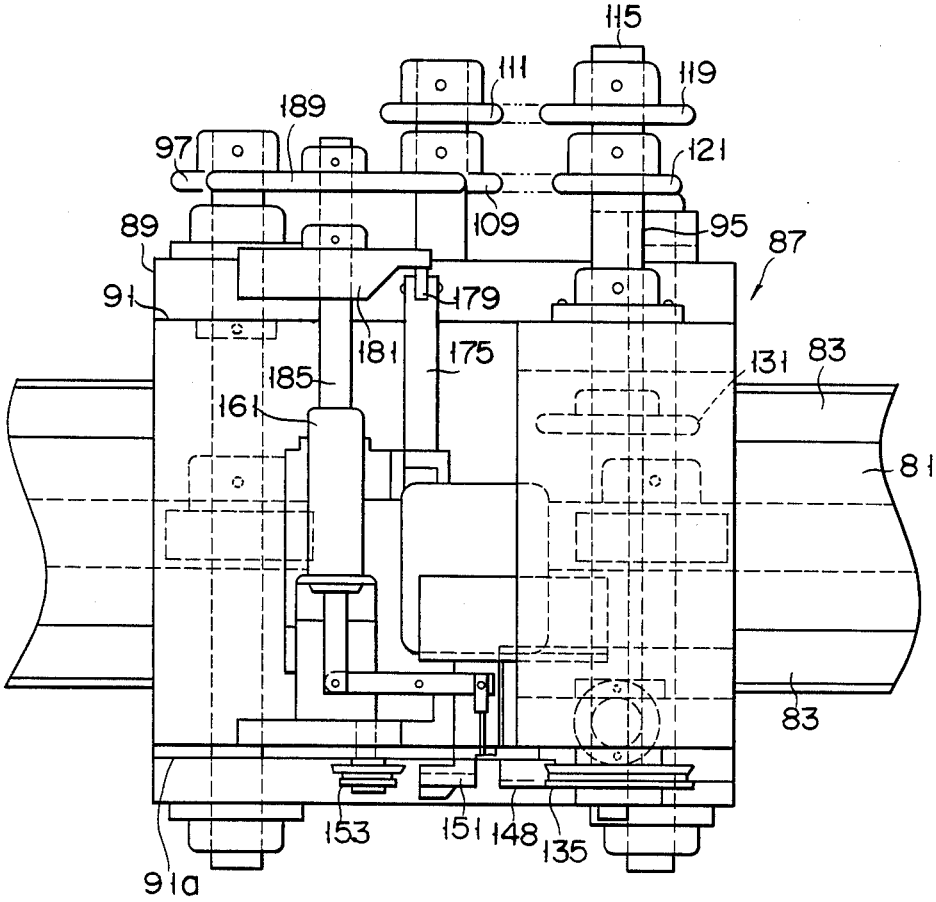
Figure 51:
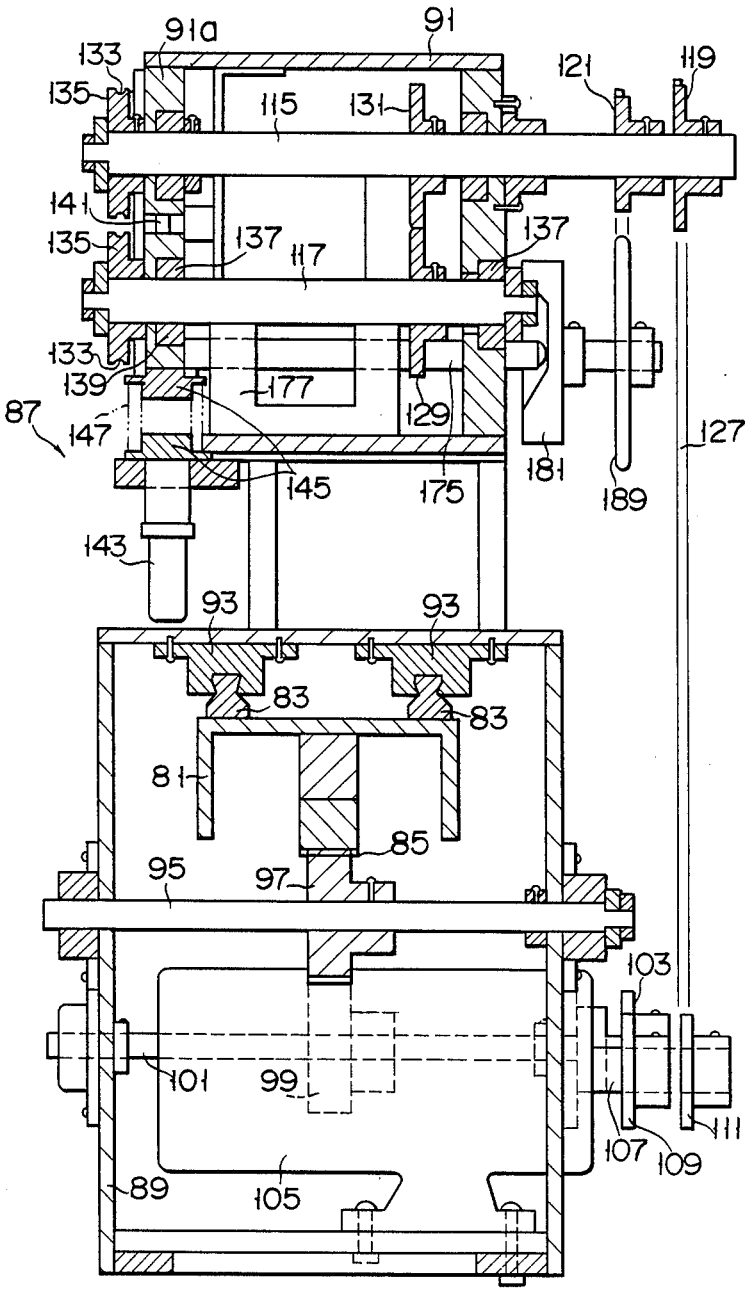
FIG. 51 is a sectional view taken along a line L-L in FIG. 50.

The paired movable bodies 87 shown in FIGS. 2A, 2B and 10 are moved toward each other on guide rails 83 by the force generated when the holding rollers 135 pull the wire 27. The movable bodies 87 may also be driven by motors 105 which run along the guide rails, as shown in FIGS. 48A, 48B, 49, 50 and 51. A pair of rails 83 is laid on the upper face of the traverse member 81, while a rack 85 is attached to the underside thereof; and a pair of movable bodies 87 is mounted on the guide rails 83, as shown in FIGS. 48A and 48B. The movable body 87 comprises lower and upper casings 89 and 91 which are combined as a unit, a pair of pedestals 93 which are engaged to be freely slidable, and guide rails 83 which are located at the upper inner face of the lower casing 89, as shown in FIGS. 49 and 50. Further, a pair of first shafts 95 is penetrated to be freely rotatable through the lower casing 89 from front to back. First gears 97 are fitted onto these first shafts 95 and are engaged with the rack 85. A second shaft 101 onto which a second gear 99 is fitted is held to be freely rotatable, in the lower casing 89 so that the second gear 99 is engaged with the first one 97. One end of the second shaft 101 is projected outward from the front of the lower casing 89, and a first additional sprocket 203 is fitted onto this projected end of the second shaft 101. A driver motor 105 is housed in the lower casing 89. Its rotating shaft 107 is projected outside the back of the lower casing 89. Second and third additional sprockets 109 and 111 are fitted onto this projected end of the rotating shaft 107. A chain 113 is stretched between the first and second sprockets 103 and 109; and the rotation of the shaft 107 of the driver motor 105 is transmitted to the first gear 97 through the chain 113. Therefore, the movable bodies 87 are driven by the rotation of the first gears 97 to run on the paired guide rails 83.

A first chain 127 is stretched between the third additional sprocket 111 and the first sprocket 119 which has been already described. Therefore, the rotating force of the motor 105 is transmitted to the holding rollers 135 via the sprockets 111, 119 and shaft 115. The same parts as those in FIGS. 1A through 22 are represented by the same reference numerals as in FIGS. 48A, 48B, 50 and 51, and a description of these parts is omitted.

Figure 52:
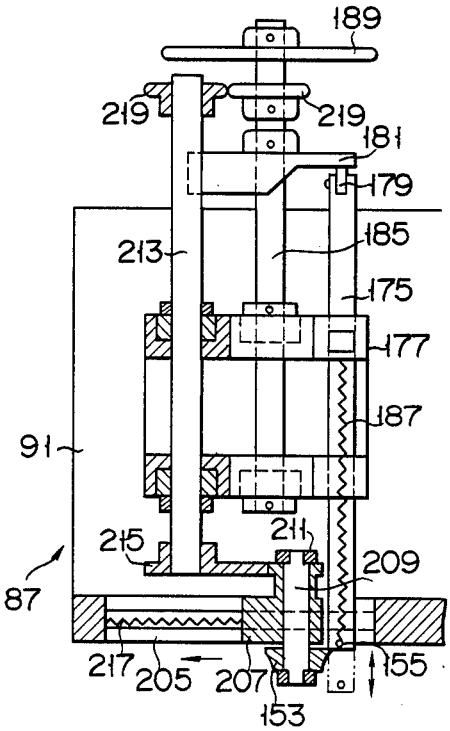
FIG. 52 is a plan view showing the arrangement of attaching the shaping roller in accordance with a third embodiment of a shaping apparatus of the present invention.
Figure 53:
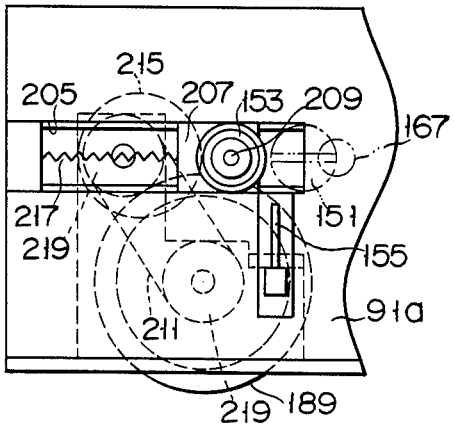
FIG. 53 is a front view showing the arrangement of attaching the shaping roller shown in FIG. 52.

It should be understood that the present invention is not limited to the above-described embodiment, and that the shaping rollers 153 in the first shaping apparatus may be arranged as shown in FIGS. 52 and 53. More specifically, a guide groove 205 is formed in the front plate 91*a* of the upper casing 91 of the movable body 87 along the width of the front plate 91*a* and a support 207 is arranged to be freely slidable in the guide groove 205. An attaching rod 209 is penetrated through the support 207 from the front to the back thereof. The shaping roller 153 is fitted onto that end of the attaching rod 209 which projects forward from the front of the support 207, while a cam follower 211 is fitted onto the other end thereof which is located in the upper casing 91. A sixth shaft 213 is supported to be freely rotatable and parallel to the fifth shaft 185, by the pedestral 177 which is located in the upper casing 91. A cam 215 is fitted onto one end of the sixth shaft 213. The support 207 is urged in the direction shown by the arrow by means of a tension spring 217, and the cam follower 211 arranged on the support 207 is contacted with the outer circumferential face of the cam 215. Further, pulleys 219 having same number of teeth are fitted onto the other ends of the fifth and sixth shafts 185 and 213, and a chain 211 is stretched between these pulleys 219.

According to the above-described arrangement, the sixth shaft 213 also rotates when the fifth shaft 185 is rotated at the time of shaping the spring unit 250 by means of the movable bodies 87. When the sixth shaft 213 rotates, the support 207 to which the cam follower 211 is attached is slid along the guide groove 205, according to the shape of the cam 215 which is fitted onto the shaft 213. Therefore, the interval between the shaping roller 153 attached to the support 207 and the guide 151 attached to the rod 167 of the third rotating cylinder 165 is changed, thereby enabling the diameter of the spiral formed at the both end portions of the wire material 27 to be changed.

Figure 28:
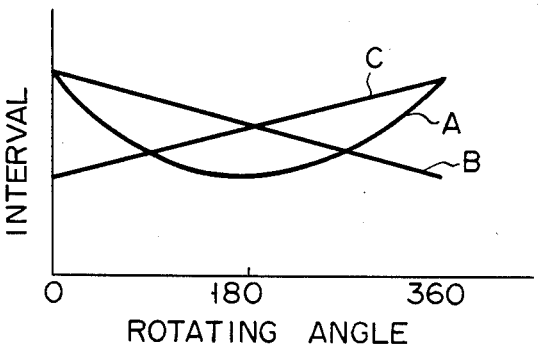
FIG. 28 is a graph showing the relation between the interval from the shaping roller to the guide body and the rotating angle of the shaping roller.
Figure 29:
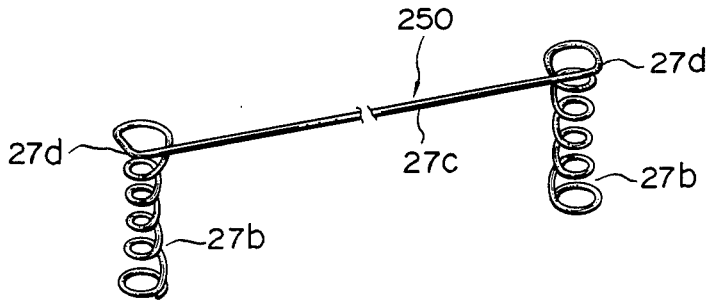
FIGS. 29, 30 and 31 are perspective views showing various kinds of spring units formed, varying the interval between the shaping roller and the guide body.

When the shape of the cam 215 is set in such a way that the interval between the shaping roller 153 and the guide 151 is changed as shown by curve A in FIG. 28, in response to the rotation of the sixth shaft 213, each of the spirals 27*b* can be formed like a hand drum as shown in FIG. 29. When the interval is changed as shown by line B, each of the spirals 27*b* can be formed like a reverse cone as shown in FIG. 30; and when the interval is changed as shown by line C, it can be formed like a cone as shown in FIG. 31. Namely, the shape of the spiral spring portion 27*b* can be changed by the cam 215, thereby enabling a spring 250 having the desired properties to be formed.

What is claimed is:

1. An apparatus for manufacturing coil spring units from a wire (27) comprising:

means (51, 53, 57, 59) for slightly curving both ends of the wire (27);

a frame (1) having guide rails (83);

first and second movable bodies (87) mounted to be freely slidable on the guide rails (83);

means for driving said bodies along the guide rails;

first and second holding means (135) respectively carried on the paired movable bodies (87) to hold both end sections (27*a*) of the end-bent wire (27);

means (61) for supplying the end-bent wire (27) to the first and second holding means (135) and means for fixedly securing the wire relative to said guide rails;

first and second coil forming means (151, 153, 155) respectively carried on the movable bodies (87) to bend into a spiral coil those portions of the wire (27) which respectively extend from the first and second holding means as the movable bodies (87) move toward each other, each of the first and second coil forming means (151, 153, 155) including shaping roller means (153) in abutting contact with the wire (27) to bend it like a coil, guide member means (151) arranged between the shaping roller (153) and the associated one of the first and second holding means (135) for guiding the wire (27) suplied from the associated holding means (135) to the shaping roller (153), the diameter of one turn of the spiral being determined by the distance between the shaping roller means (153) and the guide member means (151), and pitch rod means (155) arranged between the guide member (151) and the shaping roller means (153) to determine the pitch of the sprial formed by the shaping roller means (153).

2. An apparatus for manufacturing spring units according to claim 1, wherein said driving means actuate the first and second holding means to pull the wire stretched between them and thereby to move said bodies.

3. An apparatus for manufacturing spring units according to claim 1, wherein each of the first and second coil forming means further includes a means for linearly shifting the shaping roller to change the interval between the guide means and the shaping roller means in response to the movement of each of the first and second movable bodies.

4. An apparatus for manufacturing spring units according to claim 1, wherein each of the first and second coil forming means further includes a means for reciprocating the pitch rod means in response to movement, of each of the first and second movable bodies.

5. An apparatus for manufacturing spring units according to claim 1, wherein each of the first and second coil forming means further includes a means for rotating the guide member means by about 90° to bend at right angle the boundary between a linear portion and a coil portion of the wire when the spiral portions of the wire reach a predetermined length.

6. An apparatus for manufacturing spring units according to claim 1, wherein said securing means comprises a clamping means secured to the guide rails between the first and second holding means to prevent the wire from sliding lengthwise.

7. An apparatus for manufacturing spring units according to claim 1, wherein each of the first and second holding means comprises a pair of holding rollers contacting and holding the wire between them, and wherein said driving means is coupled for driving at least one of the paired holding rollers to feed the wire from between the holding rollers.

8. An apparatus for manufacturing spring units according to claim 7, further comprising a means for approaching and separating the paired holding rollers.

9. An apparatus for manufacturing spring units according to claim 1, further comprising a means for automatically conveying the spring unit after formation has been completed of coil springs at both ends of the linear portion thereof.

10. An apparatus for manufacturing spring units according to claim 9, further comprising rotary bodies positioned to correspond to both ends of the linear portion of the spring unit conveyed, engaging members arranged at the rotary bodies, respectively, to engage both ends of the linear portion, and means for rotating the rotary bodies by a predetermined angle to bend the linear portion by means of the engaging members at the time when both ends of the linear portion are engaged with the engaging members.

11. An apparatus for manufacturing spring units according to claim 10, further comprising a means for heating and hardening the spring unit conveyed, and a means for depositing the powder of a synthetic resin on the heated spring unit to coat it.

12. A system for automatically manufacturing coil spring untis from wires, comprising:

a support;

means on said support for automatically conveying a pre-cut length of wire to a wire bending apparatus;

said wire bending apparatus comprising:

(a) at least one body movable along a given line, (b) rotatable means on said movable body which, when rotated, moves the body relative to the wire to thereby extend the wire beyond said rotatable means;

(c) means on said body in the axial path of said wire and in abutment therewith as it is extended beyond said rotatable means for shaping each extended end of said wire into a coil;

(d) first means for automatically producing a desired pitch; and (e) second means for automatically producing a desired coil diameter;

means attached to said support for fixing said wire relative to said support so that its axis is substantially parallel to said given line; and means for driving said rotatable means.

13. The system of claim 12, wherein said at least one body comprises two bodies movable by said driving means along said given line toward each other.

14. The system of claim 13, wherein said first and second means are carried on said movable bodies.

15. The system of claim 14, wherein said driving means are carried on the movable bodies.

16. The system of claim 12, wherein said conveying means includes a supply of pre-cut lengths of wire, means for automatically transporting a wire to a first bending station, and means for automatically bringing the wire from said first bending station to a second bending station.

17. The system of claim 16, wherein said wire bending apparatus comprises at said first bending station a wire-end bending means for producing a curve in the wire at its tips.

18. The system of claim 17, wherein said wire bending apparatus comprises at the second bending station said at least one body.

19. The system of claim 18, wherein said rotatable means include two rollers spaced by a distance greater than the diameter of said wire, and automatic means for advancing the rollers toward each other to engage said wire therebetween.

20. The system of claim 18, wherein said conveying means includes release means for disengaging the bent tips of the wire from the wire end bending means to facilitate removal of the wire therefrom.

21. The system of claim 18, wherein said conveying means places the wire into the second bending station so that the shaping means engages the bent tip of said wire, said wire being shaped into a coil as said wire end is extended upon motion of the movable body.

22. The system of claim 21, further comprising a guide between said rotatable means and said shaping means, said guide having a slot for slidably securing said wire.

23. The system of claim 21, wherein said second means automatically varies the coil diameter by controlling the distance between the guide and said shaping means in response to the movement of said body.

24. The system of claim 23, wherein said second means comprises a cam and a cam follower means, said cam being coupled to said driving means, and said cam follower being coupled to said shaping means.

25. The system of claim 24, wherein said first means comprises a cam and a cam follower, said cam being coupled to the driving means and said cam follower being coupled to a pitch rod means movable perpendicularly to said given line for automatically controlled the coil pitch.

26. The system of claim 12, wherein said first means comprises a cam and a cam follower, said cam being coupled to the driving means and said cam follower being coupled to a pitch rod means movable perpendicularly to said given line for automatically controlling the coil pitch.

27. The system of claim 12, wherein said second means comprises a cam and a cam follower means, said cam being coupled to said driving means, and said cam follower being coupled to said shaping means.

28. The system of claim 12, wherein said rotatable means includes a circumferential surface for frictionally contacting said wire so that substantially no slippage occurs between said wire and said circumferential surface as the rotatable means is driven.

* * * * *